US005965346A

United States Patent [19]

Inagaki et al.

[11] Patent Number: 5,965,346

[45] Date of Patent: Oct. 12, 1999

[54] PHOTOTHERMOGRAPHIC MATERIAL

[75] Inventors: Yoshio Inagaki; Naoyuki Hanaki; Hirohiko Tsuzuki, all of Minami Ashigara, Japan

[73] Assignee: Fuji Photo Film Co., Ltd., Kanagawa, Japan

[21] Appl. No.: 08/904,252

[22] Filed: Jul. 31, 1997

[30] Foreign Application Priority Data

Aug. 2, 1996 [JP] Japan ..... 8-219132

[51] Int. Cl.[6] ..... G03C 1/498

[52] U.S. Cl. ..... 430/619; 430/577; 430/581; 430/584; 430/617

[58] Field of Search ..... 430/619, 617, 430/588, 592, 581, 944, 584, 577, 591

[56] References Cited

U.S. PATENT DOCUMENTS

| | | | |
|---|---|---|---|
| 4,835,096 | 5/1989 | Lea | 430/619 |
| 5,258,282 | 11/1993 | Kagami et al. | 430/619 |
| 5,429,920 | 7/1995 | Hioki et al. . | |
| 5,677,121 | 10/1997 | Tsuzuki . | |

*Primary Examiner*—Thorl Chea

*Attorney, Agent, or Firm*—Birch, Stewart, Kolasch & Birch, LLP

[57] ABSTRACT

A photothermographic material is disclosed, comprising a support having on at least one surface thereof a light-sensitive silver halide grain, an organic salt, a reducing agent for silver ion and a binder, wherein the heat-developable light-sensitive material contains a methine dye represented by formula (I).

20 Claims, No Drawings

PHOTOTHERMOGRAPHIC MATERIAL

FIELD OF THE INVENTION

The present invention relates to a photothermographic material.

BACKGROUND OF THE INVENTION

In the medical field, reduction in the amount of processing solution discharged is keenly demanded in recent years from the viewpoint of environmental conservation and space savings. To cope with the demand, technology relating to the light-sensitive heat-developable photographic material (photothermographic material) for use in medical diagnosis or photographic use, which can be effectively exposed by a laser image setter or a laser imager and can form a sharp black image having high resolution and sharpness, is required. Such a light-sensitive heat-developable photographic material can dispense with solution-based processing chemicals and afford users a more simple heat-developing system freed from impairment of the environment.

As the heat-developable light-sensitive material which seems to satisfy the above-described requirement, those where light-insensitive organic silver salt (particularly a silver salt of a long chain alkane carboxylic acid, such as silver behenate) and a reducing agent for silver ion are made present together with light-sensitive silver halide in a relatively hydrophobic binder, are known.

By adsorbing a spectral sensitizing dye to the silver halide used here, the light-sensitive material can be spectrally sensitized to light of various wavelengths.

In the silver halide photographic emulsion used in normal silver halide photographic light-sensitive materials, silver halide fine crystals are dispersed in a hydrophilic colloid represented by an aqueous gelatin solution, however, the light-sensitive silver halide in the above-described heat-developable light-sensitive material using a hydrophobic organic silver salt is present in a hydrophobic organic solvent almost free of binder and water. The spectral sensitizing dye used in spectral sensitization of normal silver halide emulsion is generally adsorbed with difficultly to silver halide fine crystal in an organic solvent, accordingly, when it is used for the spectral sensitization of silver halide of the light-sensitive material using an organic silver salt, there arise problems such that the sensitivity is not sufficiently high and the capability changes during storage, such as extreme reduction in the sensitivity or increase of fogging.

The reduction in sensitivity is a serious obstacle particularly in achieving high sensitivity necessary for increasing the scanning speed upon scan exposure with a semiconducting laser light which has been rapidly advanced in recent years. Further, desorption and decomposition from the silver halide fine crystal is outstanding in the case of a spectral sensitizing dye for the infrared region, and improvement in this respect is demanded.

On the other hand, the semiconducting laser technology marking a rapid progress in recent years has succeeded in miniaturizing the output device of an image for medical treatment. Naturally, technology of infrared ray-sensitive light-heat silver halide photographic materials has been developed. The technology of spectral sensitization is disclosed in JP-B-3-10391 (the term "JP-B" as used herein means an "examined Japanese patent publication"), JP-B-6-52387, JP-B-5-341432, JP-A-6-194781 (the term "JP-A" as used herein means an "unexamined published Japanese patent application") and JP-A-6-301141, and the antihalation technology is disclosed in JP-A-7-13295 and U.S. Pat. No. 5,380,635. According to these techniques, the sensitizing dye or the antihalation dye in the light-sensitive materials postulating exposure to infrared ray can be greatly reduced in the absorption of visible light, and a substantially colorless light-sensitive material can be easily produced.

The dye which absorbs infrared ray and effects spectral sensitization is generally high in the HOMO and has strong reducing ability, accordingly, it reduces silver ion in the light-sensitive material and the light-sensitive material is liable to be badly fogged. In particular, when the light-sensitive material is stored under high-temperature and high-humidity conditions or over a long period of time, problems accompanying the outstanding change in capability are caused. If a dye having low HOMO is used for preventing the deterioration of storability, the LUMO becomes relatively low, as a result, the spectral sensitization efficiency is reduced and the sensitivity is lowered. These problems of sensitivity and storability are not limited to wet photographic materials but more notable in the heat-developable photographic material to which the present invention relates.

The reducing ability of dye is naturally greater as the amount of dye is larger. However, if the amount of dye is reduced, light entering the light-sensitive material cannot be satisfactorily absorbed and lack of sensitivity results. Particularly, in the heat-developable light-sensitive material using a binder having high lipophilic property, as described above, adsorption of a dye to silver halide as a light-sensitive element is weak and unless a sufficiently large amount of dye is added, the sensitivity becomes deficient.

SUMMARY OF THE INVENTION

An object of the present invention is to provide a heat-developable photographic light-sensitive (photothermographic) material ensured with good storability, low fogging and high sensitivity.

The object of the present invention has been attained by the following means:

(1) a photothermographic material comprising a support having on at least one side thereof a light-sensitive silver halide grain, an organic salt, a reducing agent for silver ion and a binder, wherein the photothermographic material contains a methine dye represented by the following formula (I):

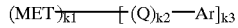

$$(MET)_{k1}-[(Q)_{k2}-Ar]_{k3} \quad (I)$$

wherein MET represents an atomic group having a methine dye structure, Q represents a divalent linking group comprising an atom or atomic group containing at least one of a carbon atom, a nitrogen atom, a sulfur atom and an oxygen atom, Ar represents a group having a polycyclic aromatic ring system compound comprising 8 or more atoms exclusive of nitrogen, k1 represents 1 or 2, k2 represents 0 or 1, and k3 represents 1, 2, 3 or 4;

(2) a photothermographic material as described in item (1), wherein the light-sensitive silver halide grain is spectrally sensitized in the range of from 600 to 1,400 nm.

In a preferred embodiment, Ar is Ar' wherein Ar' represents a group having aromaticity and having a polycyclic carbon compound with the number of carbon atoms constituting the ring being 9 or more.

In a more preferred embodiment, MET in formula (I) has a hexamethine merocyanine structure or a pentamethine or heptamethine cyanine structure.

DETAILED DESCRIPTION OF THE INVENTION

The present invention is described in more detail below.

The methine dye structure of MET in formula (I) represents a cyanine structure formed by linking a nitrogen-containing heterocyclic ring usually called a basic nucleus with another nitrogen-containing heterocyclic ring through a conjugate double bond so that the rings can be conjugated to each other therebetween, a merocyanine structure formed by linking a heterocyclic ring called an acidic nucleus with a basic nucleus through a conjugate double bond so that the carbonyl group in the acidic nucleus and the nitrogen atom in the basic nucleus can be conjugated to each other, a rhodacyanine structure combined with the above-described structure, an oxonol structure, a hemicyanine structure, a styryl structure or a benzylidene structure.

Examples of the methine dye structure include those described, for example, in T. H. James (compiler), *Theory of Photographic Process*, Chapter 8, Macmillan (1977), and D. M. Sturmer, *The Chemistry of Heterocyclic Compounds*, edited by A. Weissberger and E. C. Taylor, John Wiley and Sons (New York) (1977).

Q represents a divalent linking group comprising an atom or atomic group containing at least one of a carbon atom, a nitrogen atom, a sulfur atom and an oxygen atom.

Q preferably represents a divalent linking group having 20 or less carbon atoms and formed of an alkylene group (e.g., methylene, ethylene, propylene, butylene, pentylene), an arylene group (e.g., phenylene, naphthylene), an alkenylene group (e.g., ethylene, propenylene), a sulfonyl group, a sulfinyl group, a thioether group, an ether group, a carbonyl group, —$NR^1$ (wherein $R^1$ represents a hydrogen atom, a substituted or unsubstituted alkyl group or a substituted or unsubstituted aryl group) or a heterocyclic divalent group (e.g., 6-chloro-1,3,5-triazine-2,4-diyl, pyrimidine-2,4-diyl, quinoxaline-2,3-diyl) individually or in combination.

k1 represents 1 or 2, k2 represents 0 or 1, and k3 represents 1, 2, 3 or 4. Preferably, k1 represents 1, k2 represents 0 or 1, and k3 represents 1 or 2.

Ar and Ar' are described below. The aromaticity is defined in Bunichi Tama et al (compiler), *Iwanami Rikagaku Jiten* (*Iwanami Physiochemistry Dictionary*), 3*rd Edition, Enlarged*, pp. 1258-1259, Iwanami Shoten (1981).

Specific examples of the polycyclic compound represented by Ar or Ar' are set forth below.

(a)

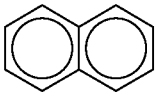

-continued (b)

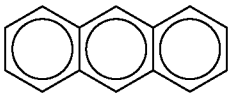

(c)

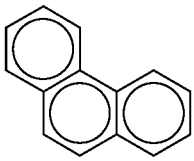

(d)

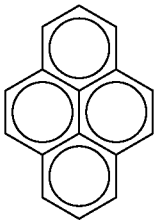

(e)

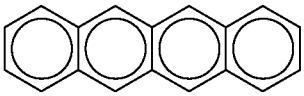

(f)

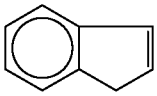

(g)

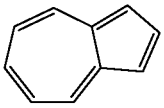

(h)

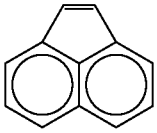

(i)

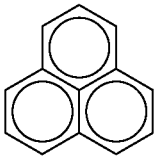

(j)

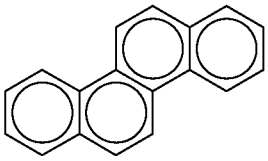

-continued (k)

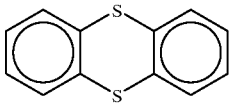

(l)

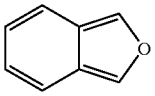

(m)

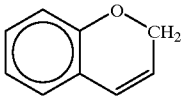

(n)

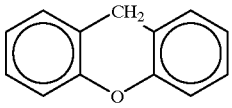

(o)

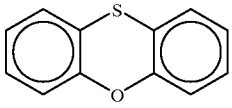

(p)

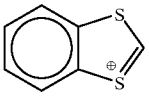

(q)

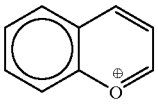

(r)

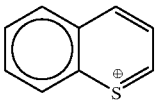

(s)

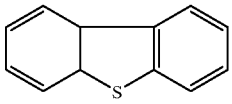

(t)

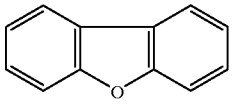

Examples of the substituent of the polycyclic compound include a hydrogen atom, a substituted or unsubstituted alkyl group (e.g., methyl, ethyl, propyl, butyl, hydroxyethyl, trifluoromethyl, benzyl, sulfopropyl, diethylaminoethyl, cyanopropyl, adamantyl, p-chlorophenethyl, ethoxyethyl, ethylthioethyl, phenoxyethyl, carbamoylethyl, carboxyethyl, ethoxycarbonylmethyl, acetylaminoethyl), a substituted or unsubstituted alkenyl group (e.g., allyl, styryl), a substituted or unsubstituted aryl group (e.g., phenyl, naphthyl, p-carboxyphenyl, 3,5-dicarboxyphenyl, m-sulfophenyl, p-acetamidophenyl, 3-caprylamidophenyl, p-sulfamoylphenyl, m-hydroxyphenyl, p-nitrophenyl, 3,5-dichlorophenyl, p-anisyl, o-anisyl, p-cyanophenyl, p-N-methylureidophenyl, m-fluorophenyl, p-tolyl, m-tolyl), a heterocyclic residue which may be substituted (e.g., pyridyl, 5-methyl-2-pyridyl, thienyl), a halogen atom (e.g., chlorine, bromine, fluorine), a mercapto group, a cyano group, a carboxyl group, a sulfo group, a hydroxy group, a carbamoyl group, a sulfamoyl group, an amino group, a nitro group, an alkoxy group which may be substituted (e.g., methoxy, ethoxy, 2-methoxyethoxy, 2-phenylethoxy), an aryloxy group which may be substituted (e.g., phenoxy, p-methylphenoxy, p-chlorophenoxy), an acyl group (e.g., acetyl, benzoyl), an acyloxy group (e.g., acyloxy), an acylamino group (e.g., acetylamino, caproylamino), a sulfonyl group (e.g., methanesulfonyl, benzenesulfonyl), a sulfonylamino group (e.g., methanesulfonylamino, benzenesulfonylamino), a carbamoyl group which may be substituted (e.g., carbamoyl, N,N-dimethylcarbamoyl, morpholinocarbonyl, piperidinocarbonyl), a sulfamoyl group which may be substituted (e.g., sulfamoyl, N,N-dimethylsulfamoyl, morpholinocarbonyl, piperidinocarbonyl), an alkylthio group which may be substituted (e.g., methylthio), a substituted amino group (e.g., diethylamino, hydroxyamino), an alkyl- or arylthio group (e.g., methylthio, carboxyethylthio, sulfobutylthio, phenylthio), an alkoxycarbonyl group (e.g., methoxycarbonyl) and an aryloxycarbonyl group (e.g., phenoxycarbonyl). These substituents each may be substituted by Ar through a divalent linking group L ($L_1$ to $L_{21}$) or a single bond.

Further, on the above-described substituent, an alkyl group, an alkenyl group, an aryl group, a hydroxy group, a carboxy group, a sulfo group, a nitro group, a cyano group, a halogen atom, an alkoxy group, an aryloxy group, an alkoxycarbonyl group, an acyl group, an acylamino group, a sulfonamino group, a carbamoyl group or a sulfamoyl group may be substituted.

Furthermore, at least one of the substituents may be a divalent linking group L or a single bond.

The hexamethine merocyanine structure of MET preferably used in the present invention is represented by the following formula (II), and the pentamethine or heptamethine cyanine structure is represented by the following formula (III):

(II)

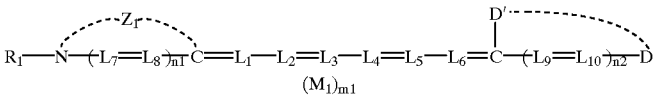

-continued (III)

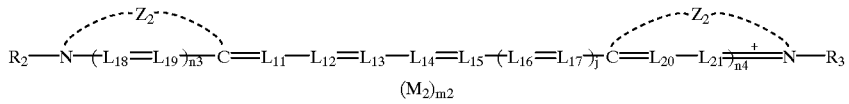

wherein $Z_1$, $Z_2$ and $Z_3$ each represents an atomic group necessary for forming a 5- or 6-membered nitrogen-containing heterocyclic ring, D and D' each represents an atomic group necessary for forming a non-cyclic or cyclic acidic nucleus, $R_1$, $R_2$ and $R_3$ each represents an alkyl group, $L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$ $L_{19}$, $L_{20}$ and $L_{21}$ each represents a methine group or a substituted methine group, which may form a ring with other methine group or with an auxochrome, n1, n2, n3 and n4 each represents 0 or 1, j represents 0 or 1, $M_1$ and $M_2$ each represents a charge neutralizing counter ion, and m1 and m2 each represents a number of 0 or greater necessary for naturalizing the charge within the molecule.

In each of formulae (II) and (III), at least one Ar is bonded through a divalent linking group Q or through a single bond.

Formulae (II) and (III) are described in more detail below.

$R_1$, $R_2$ and $R_3$ each is preferably an unsubstituted alkyl group having 18 or less carbon atoms (e.g., methyl, ethyl, propyl, butyl, pentyl, octyl, decyl, dodecyl, octadecyl) or a substituted alkyl group {for example, an alkyl group having 18 or less carbon atoms substituted by a carboxy group, a sulfo group, a cyano group, a halogen atom (e.g., fluorine, chlorine, bromine), a hydroxy group, an alkoxycarbonyl group having 8 or less carbon atoms, which may be substituted (e.g., methoxycarbonyl, ethoxycarbonyl, phenoxycarbonyl, benzyloxycarbonyl), an alkoxy group having 8 or less carbon atoms, which may be substituted (e.g., methoxy, ethoxy, benzyloxy, phenethyloxy), a monocyclic aryloxy group having 10 or less carbon atoms, which may be substituted (e.g., phenoxy, p-tolyloxy), an acyloxy group having 3 or less carbon atoms, which may be substituted (e.g., acetyloxy, propionyloxy), an acyl group having 8 or less carbon atoms, which may be substituted (e.g., acetyl, propionyl, benzoyl, mesyl), a carbamoyl group having 8 or less carbon atoms, which may be substituted (e.g., carbamoyl, N,N-dimethylcarbamoyl, morpholinocarbonyl, piperidinocarbonyl), a sulfamoyl group having 8 or less carbon atoms, which may be substituted (e.g., sulfamoyl, N,N-dimethylsulfamoyl, morpholinosulfonyl, piperidinosulfonyl) or an aryl group having 10 or less carbon atoms, which may be substituted (e.g., phenyl, 4-chlorophenyl, 4-methylphenyl, α-naphthyl)}.

$R_1$, $R_2$ and $R_3$ each is more preferably an unsubstituted alkyl group (e.g., methyl, ethyl, n-propyl, n-butyl, n-pentyl, n-hexyl), a carboxyalkyl group (e.g., 2-carboxyethyl, carboxymethyl), a sulfoalkyl group (e.g., 2-sulfoethyl, 3-sulfopropyl, 4-sulfobutyl, 3-sulfobutyl).

$(M_1)_{m1}$ and $(M_2)_{m2}$ each is included in the formulae for showing the presence or absence of a cation or an anion when it is required for neutralizing the ion charge of the dye. It is dependent on the auxochrome or the substituent whether or not a dye is a cation or an anion, or whether or not the dye has a net ion charge. Typical cations are an inorganic or organic ammonium ion and an alkali metal ion. On the other hand, the anion may be specifically either an inorganic anion or an organic anion, and examples thereof include a halogen anion (e.g., fluorine ion, chlorine ion, bromine ion, iodine ion), a substituted arylsulfonate ion (e.g., p-toluenesulfonate ion, p-chlorobenzenesulfonate ion), an aryldisulfonate ion (e.g., 1,3-benzenedisulfonate ion, 1,5-naphthalenedisulfonate ion, 2,6-naphthalenedisulfonate ion), an alkylsulfate ion (e.g., methylsulfate ion), a sulfate ion, a thiocyanate ion, a perchlorate ion, a tetrafluoroborate ion, a picrate ion, an acetate ion and a trifluoromethanesulfonate ion.

Preferred are an ammonium ion, an iodine ion and a p-toluenesulfonate ion.

Examples of the nucleus formed by $Z_1$, $Z_2$ or $Z_3$ include a thiazole nucleus {for example, a thiazole nucleus (e.g., thiazole, 4-methylthiazole, 4-phenylthiazole, 4,5-dimethylthiazole, 4,5-diphenylthiazole), a benzothiazole nucleus (e.g., benzothiazole, 4-chlorobenzothiazole, 5-chlorobenzothiazole, 6-chlorobenzothiazole, 5-nitrobenzo-thiazole, 4-methylbenzothiazole, 5-methylbenzothiazole, 6-methylbenzothiazole, 5-bromobenzothiazole, 6-bromobenzo-thiazole, 5-iodobenzothiazole, 5-phenylbenzothiazole, 5-methoxybenzothiazole, 6-methoxybenzothiazole, 5-ethoxy-benzothiazole, 5-ethoxycarbonylbenzothiazole, 5-carboxy-benzothiazole, 5-phenethylbenzothiazole, 5-fluorobenzothiazole, 5-chloro-6-methylbenzothiazole, 5,6-dimethylbenzothiazole, 5,6-dimethoxybenzothiazole, 5-hydroxy-6-methylbenzothiazole, tetrahydrobenzothiazole, 5-phenylbenzothiazole) and a naphthothiazole nucleus (e.g., naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole)}, a thiazoline nucleus (e.g., thiazoline, 4-methylthiazoline, 4-nitrothiazoline), an oxazole nucleus {for example, an oxazole nucleus (e.g., oxazole, 4-methyloxazole, 4-nitroxazole, 5-methyloxazole, 4-phenyloxazole, 4,5-diphenyloxazole, 4-ethyloxazole), a benzoxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethyl-benzoxazole, 5-hydroxybenzoxazole, 5-caboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole) and a naphthoxazole nucleus (e.g., naphth[2,1-d]oxazole, naphth[1,2-d]oxazole, naphth[2,3-d]oxazole, 5-nitronaphth[2,1-d]oxazole)}, an oxazoline nucleus (e.g., 4,4-dimethyloxazoline), a selenazole nucleus {for example, a selenazole nucleus (e.g., 4-methylselenazole, 4-nitroselenazole, 4-phenylselenazole), a benzoselenazole nucleus (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, 5,6-dimethylbenzoselenazole) and a naphthoselenazole nucleus (e.g., naphth[2,1-d]selenazole, naphth[1,2-d]selenazole)}, a selenazoline nucleus (e.g., selenazoline, 4-methylselenazoline), a tellurazole nucleus {for example, a tellurazole nucleus (e.g., tellurazole, 4-methyltellurazole, 4-phenyltellurazole), a benzotellurazole (e.g., benzotellurazole, 5-chlorobenzotellurazole, 5-methylbenzotellurazole, 5,6-dimethylbenzotellurazole, 6-methoxybenzotellurazole), a naphthotellurazole nucleus (e.g., naphtho[2,1-d]tellurazole, naphtho[1,2-d] tellurazole)}, a tellurazoline nucleus (e.g., tellurazoline, 4-methyltellur-azoline), a 3,3-dialkylindolenine nucleus (e.g., 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-methylindolenine, 3,3-dimethyl-5-chloroindolenine), an imidazole nucleus {for example, an imidazole nucleus (e.g., 1-alkylimidazole, 1-alkyl-4-phenylimidazole, 1-arylimidazole), a benzimidazole nucleus (e.g., 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6-chloro-5-trifluoromethylbenzimidazole, 1-allyl-5,6-dichlorobenzimidazole, 1-allyl-5-chlorobenzimidazole, 1-arylbenzimidazole, 1-aryl-5-chlorobenzimidazole, 1-aryl-5,6-dichlorobenzimidazole, 1-aryl-5-methoxybenzimidazole, 1-aryl-5-cyanobenzimidazole) and a naphthimidazole nucleus (e.g., alkylnaphth[1,2-d] imidazole, 1-arylnaphth[1,2-d]imidazole), wherein the alkyl group is preferably an alkyl group having from 1 to 8 carbon atoms, such as an unsubstituted alkyl group (e.g., methyl, ethyl, propyl, isopropyl, butyl) and a hydroxyalkyl group (e.g., 2-hydroxyethyl, 3-hydroxypropyl), more preferably a methyl group or an ethyl group, and the aryl group is phenyl, halogen(e.g., chloro)-substituted phenyl, alkyl(e.g., methyl)-substituted phenyl or alkoxy(e.g., methoxy)-substituted phenyl}, a pyridine nucleus (e.g., 2-pyridine, 4-pyridine, 5-methyl-2-pyridine, 3-methyl-4-pyridine), a quinoline nucleus {for example, a quinoline nucleus (e.g., 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-phenyl-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, 6-chloro-4-quinoline) and an isoquinoline nucleus (e.g., 6-nitro-1-isoquinoline, 3 4-dihydro-1-isoquinoline, 6-nitro-3-isoquinoline)}, an imidazo[4,5-b]quinoxaline nucleus (e.g., 1,3-diethylimidazo [4,5-b]quinoxaline, 6-chloro-1,3-diallylimidazo[4,5-b] quinoxaline), an oxadiazole nucleus, a thiadiazole nucleus, a tetrazole nucleus and a pyrimidine nucleus.

The nucleus formed by $Z_1$, $Z_2$ or $Z_3$ is preferably a benzothiazole nucleus, a naphthothiazole nucleus, a benzoxazole nucleus, a naphthoxazole nucleus, a benzimidazole nucleus, a 2-quinoline nucleus or a 4-quinoline nucleus.

D and D' each represents an atomic group necessary for forming an acidic nucleus together and the acidic nucleus may have an acidic nucleus form of any general merocyanine dye. In a preferred form, D is a thiocarbonyl group or a carbonyl group and D' is the remaining atomic group necessary for forming the acidic nucleus.

D and D' may form together a 5- or 6-membered heterocyclic ring comprising a carbon atom, a nitrogen atom and a chalcogen atom (typically, oxygen, sulfur, selenium or tellurium).

Preferred examples of the nucleus formed by D and D' together include a 2-pyrazolin-5-one nucleus, a pyrazolidine-3,5-dione nucleus, an imidazolin-5-one nucleus, a hydantoin nucleus, a 2- or 4-thiohydantoin nucleus, 2-iminoxazolidin-4-one nucleus, a 2-oxazolin-5-one nucleus, a 2-thioxazolidine-2,4-dione nucleus, an isoxazolin-5-one nucleus, a 2-thiazolin-4-one nucleus, a thiazolidin-4-one nucleus, a thiazolidin-2,4-dione nucleus, a rhodanine nucleus, a thiazolidine-2,4-dione nucleus, an isorhodanine nucleus, an indane-1,3-dione nucleus, a thiophen-3-one nucleus, a thiophen-3-one-1,1-dioxide nucleus, an indolin-2-one nucleus, an indolin-3-one nucleus, an indazolin-3-one nucleus, a 2-oxaindazolinium nucleus, a 3-oxaindazolinium nucleus, a 5,7-dioxo-6,7-dihydrothiazolo[3,2-a]pyrimidine nucleus, a cyclohexane-1,3-dione nucleus, a 3,4-dihydroisoquinolin-4-one nucleus, 1,3-dioxane-4,6-dione nucleus, a barbituric acid nucleus, a 2-thiobarbituric acid nucleus, a chroman-2,4-dione nucleus, an indazolin-2-one nucleus and a pyrido[1,2-a]pyrimidine-1,3-dione nucleus.

More preferred are 3-alkylrhodanine, 3-alkyl-2-thioxazolidin-2,4-dione and 3-alkyl-2-thiohydantoin.

The substituent bonded to the nitrogen atom of the nucleus is preferably a hydrogen atom, an alkyl group having from 1 to 18, preferably from 1 to 7, more preferably from 1 to 4, carbon atoms (e.g., methyl, ethyl, propyl, isopropyl, butyl, isobutyl, hexyl, octyl, dodecyl, octadecyl), a substituted alkyl group (for example, an aralkyl group (e.g., benzyl, 2-phenylethyl), a hydroxyalkyl group (e.g., 2-hydroxyethyl, 3-hyroxypropyl), a carboxyalkyl group (e.g., 2-carboxyethyl, 3-carboxypropyl, 4-carboxybutyl, carboxymethyl) and an alkoxyalkyl group (e.g., 2-methoxyethyl, 2-(2-methoxyethoxy)ethyl), a sulfoalkyl group (e.g., 2-sulfoethyl, 3-sulfopropyl, 3-sulfobutyl, 4-sulfobutyl, 2-[3-sulfopropoxy]ethyl, 2-hydroxy-3-sulfopropyl, 3-sulfopropoxyethoxyethyl), a sulfatoalkyl group (e.g., 3-sulfatopropyl, 4-sulfatobutyl), a heterocyclic ring-substituted alkyl group (e.g., 2-(pyrrolidin-2-on-1-yl) ethyl, tetrahydrofurfuryl, 2-morpholinoethyl, 2-acetoxyethyl, carbomethoxymethyl, 2-methanesulfonylaminoethyl), an allyl group, an aryl group (e.g., phenyl, 2-naphthyl), a substituted aryl group (e.g., 4-carboxyphenyl, 4-sulfophenyl, 3-chlorophenyl, 3-methylphenyl) or a heterocyclic group (e.g., 2-pyridyl, 2-thiazolyl), still more preferably an unsubstituted alkyl group (e.g., methyl, ethyl, n-propyl, n-butyl, n-pentyl, n-hexyl), a carboxyalkyl group (e.g., carboxymethyl, 2-carboxyethyl) or a sulfoalkyl group (e.g., 2-sulfoethyl).

The carbon atom contained in the nucleus may be substituted by the group described above as the substituent of the polycyclic compound.

$L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$ and $L_{21}$ each represents a methine group or a substituted methine group {substituted, for example, by a substituted or unsubstituted alkyl group (e.g., methyl, ethyl, 2-carboxyethyl), a substituted or unsubstituted aryl group (e.g., phenyl, o-carboxyphenyl), a heterocyclic group (e.g., barbituric acid), a halogen atom (e.g., chlorine, bromine), an alkoxy group (methoxy, ethoxy), an amino group (e.g., N,N-diphenylamino, N-methyl-N-phenylamino, N-methylpiperazino) or an alkylthio group (e.g., methylthio, ethylthio)}, which may form a ring with other methine group or may form a ring with an auxochrome.

Either one pair of $L_2$ and $L_4$ or $L_3$ and $L_5$ preferably form a ring together. Further, one of pairs $L_{12}$ and $L_{14}$, $L_{13}$ and $L_{15}$, and $L_{14}$ and $L_{16}$ preferably form a ring together.

Particularly preferred examples of the ring structure of the ring formed by $L_1$ and $L_4$, $L_{12}$ and $L_{14}$ or $L_{14}$ and $L_{16}$ are set forth below:

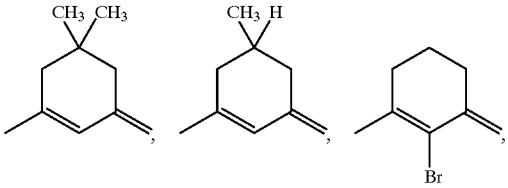

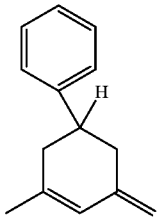

Particularly preferred examples of the ring structure of the ring formed by $L_3$ and $L_5$ or $L_{13}$ and $L_{15}$ are set forth below:

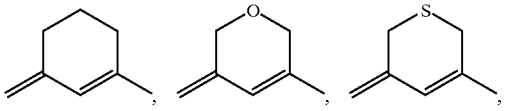

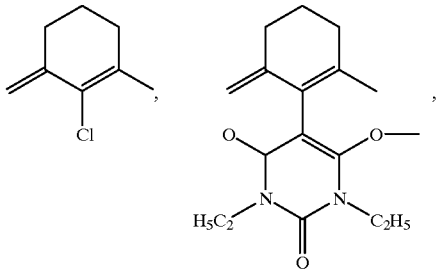

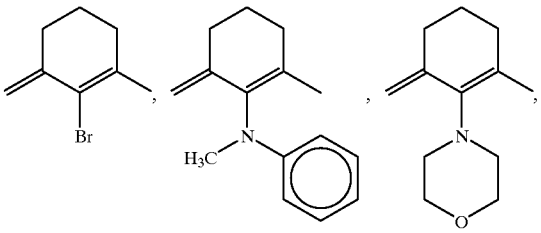

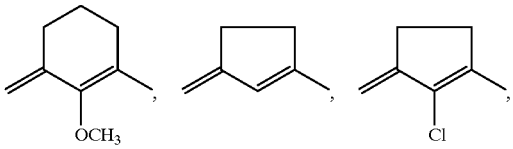

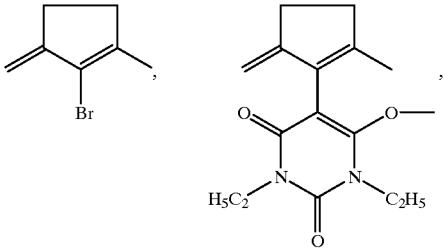

-continued

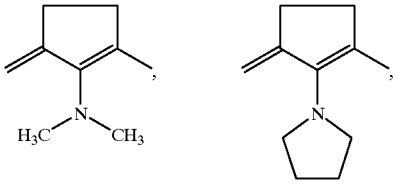

$L_4$ and $L_{14}$ each is preferably an unsubstituted methine group, a methine group substituted by an unsubstituted alkyl group (e.g., methyl), an alkoxy group (e.g., methoxy), an amino group (e.g., N,N-diphenylamino) or a halogen atom, or a methine group substituted by the acidic nucleus represented by D or D' described above.

Other L groups each is preferably an unsubstituted methine group.

In each of formulae (II) and (III), at least one $—(Q)_{k2}—Ar$ is substituted, and the substitution site thereof may be any of the 5- or 6-membered nitrogen-containing heterocyclic ring represented by $Z_1$, $Z_2$ or $Z_3$, the acidic nucleus represented by D or D', the alkyl group represented by $R_1$, $R_2$ or $R_3$, and the methine group represented by $L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$ or $L_{21}$.

The substitution site is preferably $R_1$, $R_2$, $R_3$ or the nitrogen atom of the acidic nucleus represented by D or D'.

Among the methine dyes represented by formula (I), particularly preferred is the methine dye represented by the following formula (I-a):

(I-a)

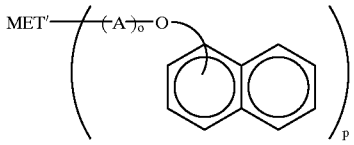

wherein A represents a methylene group, o represents 1, 2, 3, 4 or 5, p represents 1 or 2, and MET' represents pentamethine cyanine or heptamethine cyanine represented by formula (III).

In formula (I-a), the oxygen atom is bonded to the 1-or 2-position of the naphthalene ring. The naphthalene ring may be substituted by a substituent. MET' is bonded to the N-position of the basic nucleus of the methylene group.

Formula (I-a) is described in more detail below.

A preferably represents a methylene group or a substituted methylene group {substituted, for example, by a substituted or unsubstituted alkyl group (e.g., methyl, 2-carboxyethyl), a substituted or unsubstituted aryl group (e.g., phenyl, o-carboxyphenyl), a carboxy group, a halogen atom (e.g., chlorine) or an alkoxy group (e.g., methoxy)}.

A is more preferably an unsubstituted methylene group.

The naphthalene ring may be substituted by a substituent, and specific examples of the substituent include a halogen atom (e.g., chlorine, fluorine, bromine), an unsubstituted alkyl group preferably having 6 or less carbon atoms (e.g., methyl, ethyl), a substituted alkyl group preferably having 10 or less carbon atoms (e.g., benzyl, α-naphthylmethyl, 2-phenylethyl, trifluoromethyl), an acyl group preferably 10 or less carbon atoms (e.g., acetyl, benzoyl, mesyl), an acyloxy group having 10 or less carbon atoms (e.g., acetoxy), an alkoxycarbonyl group having 10 or less carbon atoms (e.g., methoxycarbonyl, ethoxycarbonyl, benzyloxycarbonyl), a substituted or unsubstituted carbamoyl group (e.g., carbamoyl, N,N-dimethylcarbamoyl, morpholino-carbonyl, piperidinocarbonyl), a substituted or unsubstituted sulfamoyl group (e.g., sulfamoyl, N,N-dimethylsulfamoyl, morpholinosulfonyl, piperidinosulfonyl), a carboxy group, a cyano group, a hydroxy group, an amino group, an acylamino group preferably 8 or less carbon atoms (e.g., acetylamino), an alkoxy group preferably having 10 or less carbon atoms (e.g., methoxy, ethoxy, benzyloxy) and an aryl group (e.g., phenyl, tolyl).

p is preferably 2.

In MET', the heterocyclic nucleus completed by $Z_2$ or $Z_3$ is preferably a benzothiazole nucleus, a naphthothiazole nucleus or a 4-quinoline nucleus, which may or may not be further condensed with a benzene ring. These nuclei each may have a substituent.

Preferred examples of the substituent include a phenyl group (which may further be substituted by a lower alkyl group, a lower alkoxy group or a halogen atom), a lower alkylthio group and a lower alkoxy group (which may further be substituted by a phenoxy group or a naphthoxy group).

When MET' is a pentamethine cyanine dye, $Z_2$ and $Z_3$ are preferably a combination of a naphthothiazole nucleus or a benzothiazole nucleus and a 4-quinoline nucleus. When MET' is a heptamethine cyanine dye, $Z_2$ and $Z_3$ each is preferably selected from a benzothiazole nucleus and a naphthothiazole nucleus.

Typical examples of the methine dye represented by formula (I) are set forth below, however, the present invention is by no means limited thereto.

1.

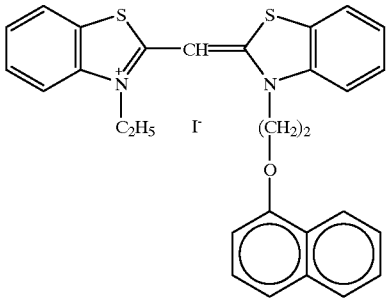

2.

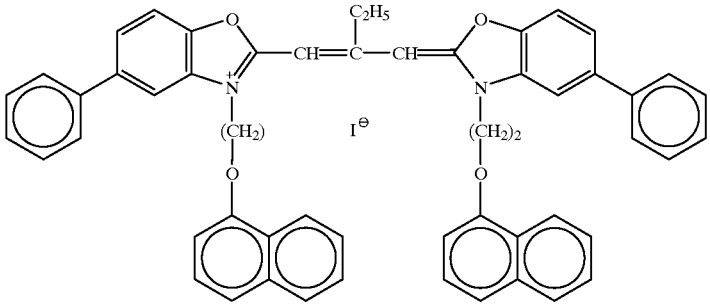

3.

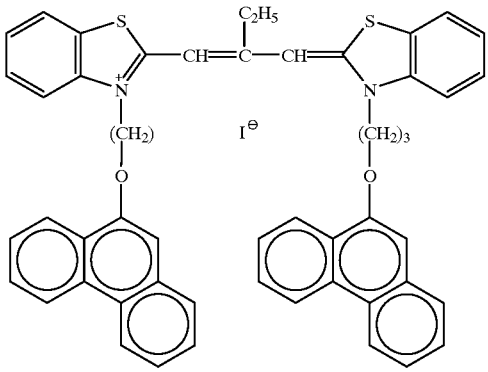

-continued
4.
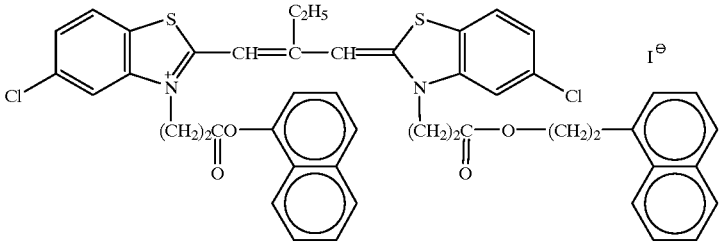
5.
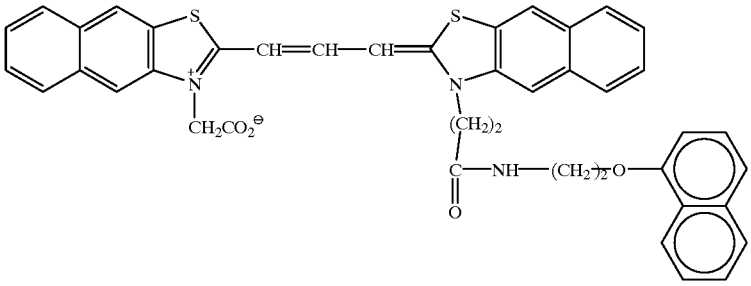
6.
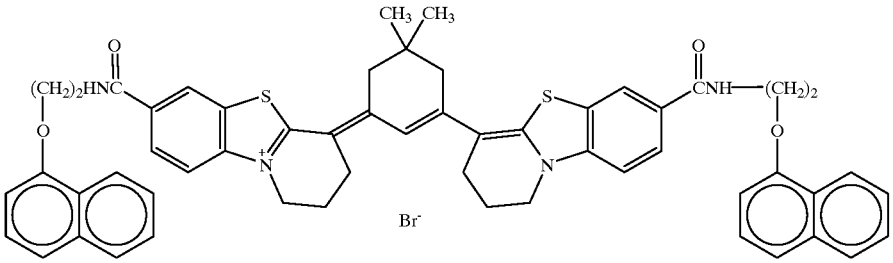
7.
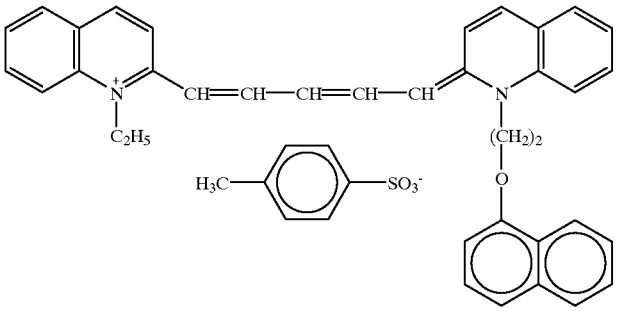
8.
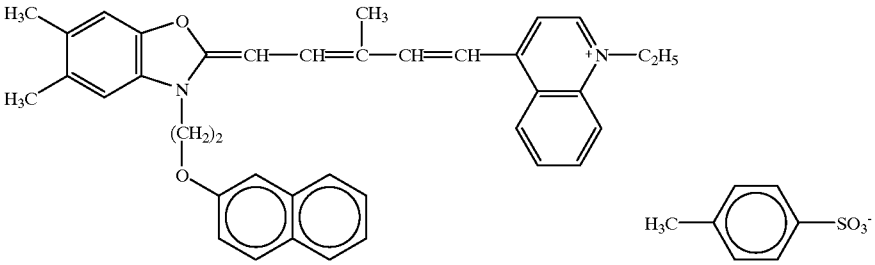

-continued
9.
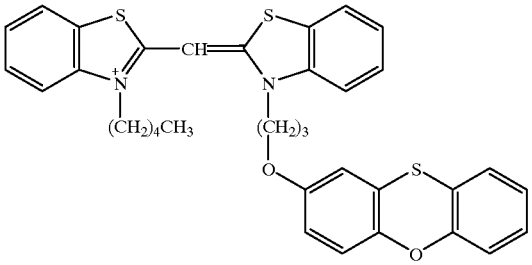
10.
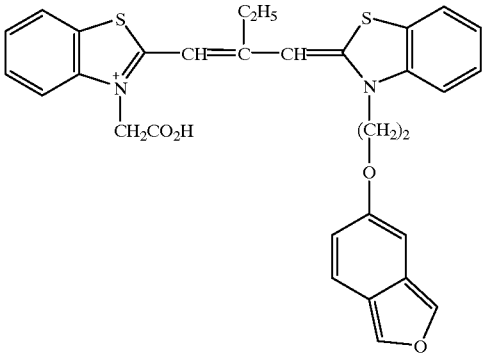
11.
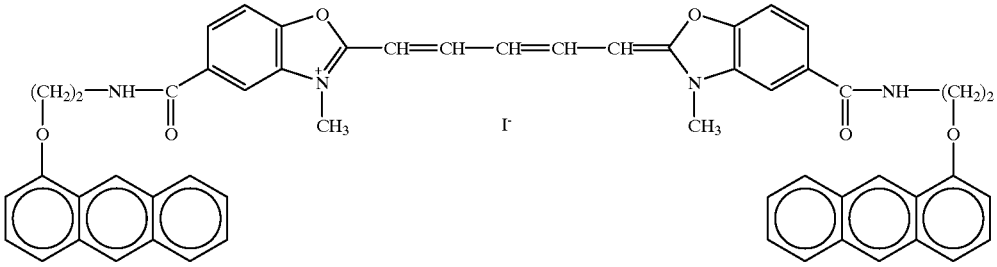
12.
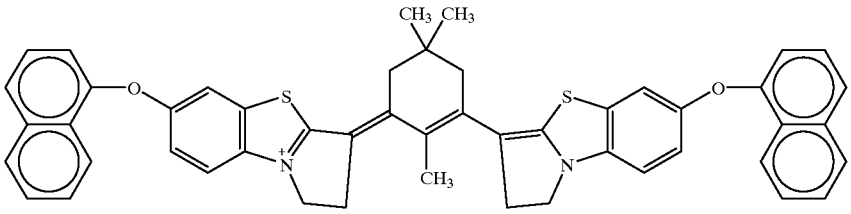
13.
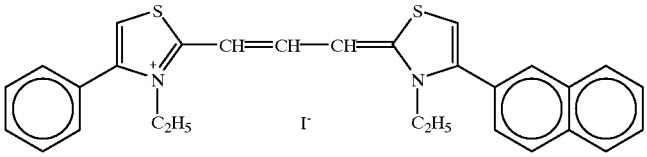
14.
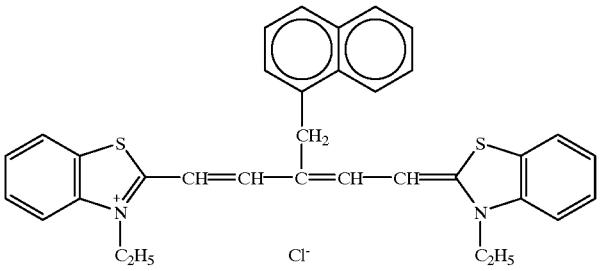

-continued
15.
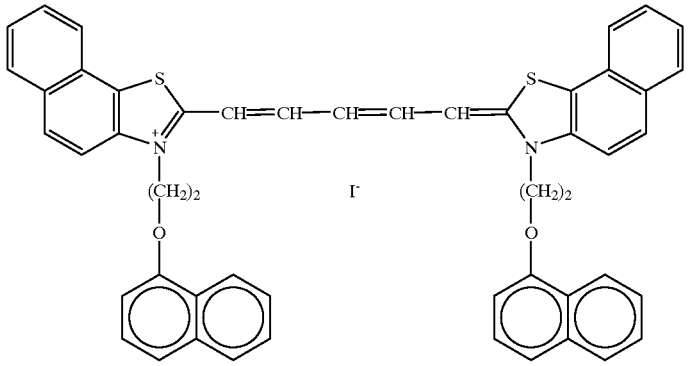
16.
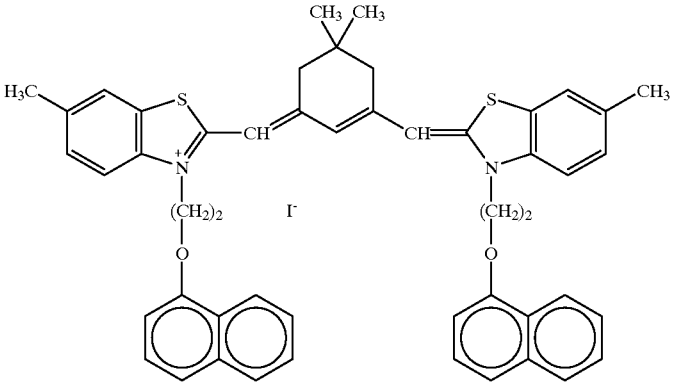
17.
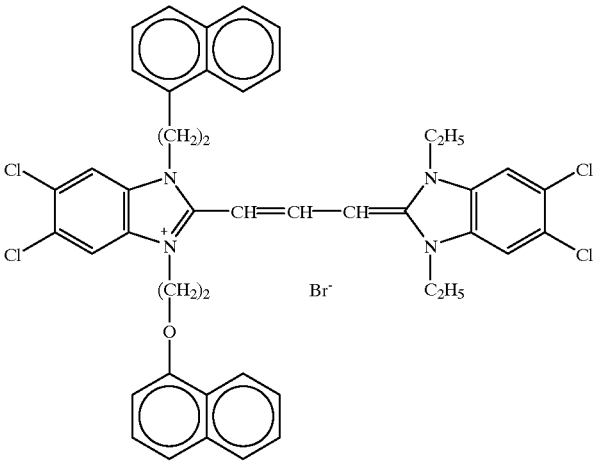
18.
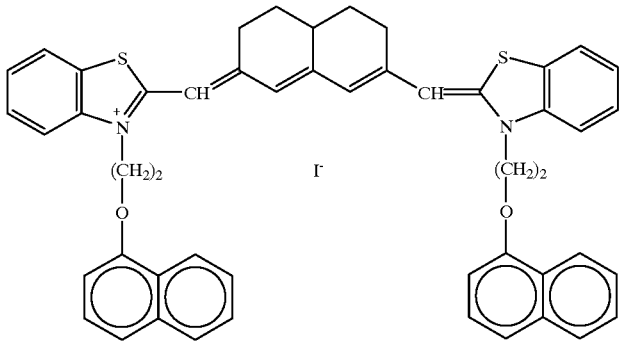

-continued
19.
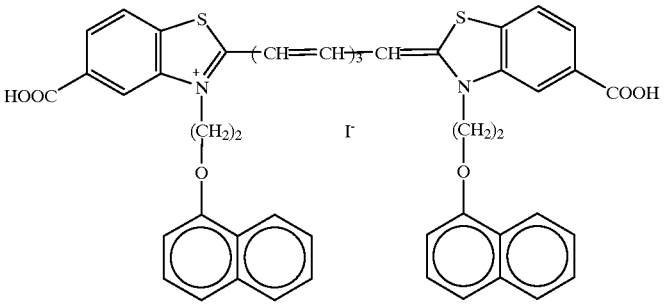
20.
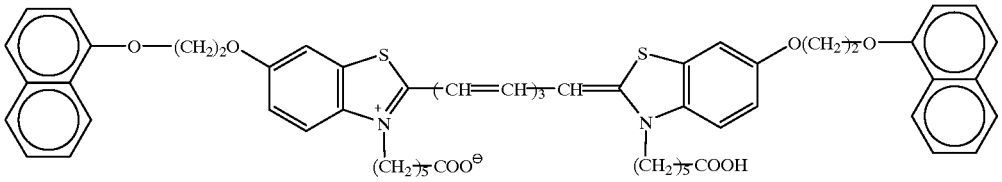
21.
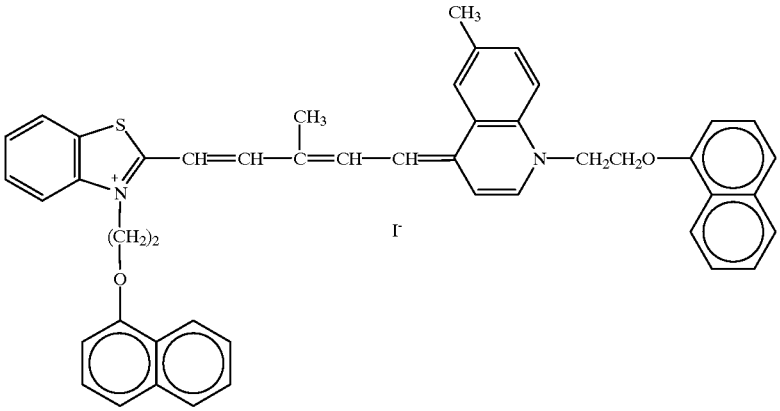
22.
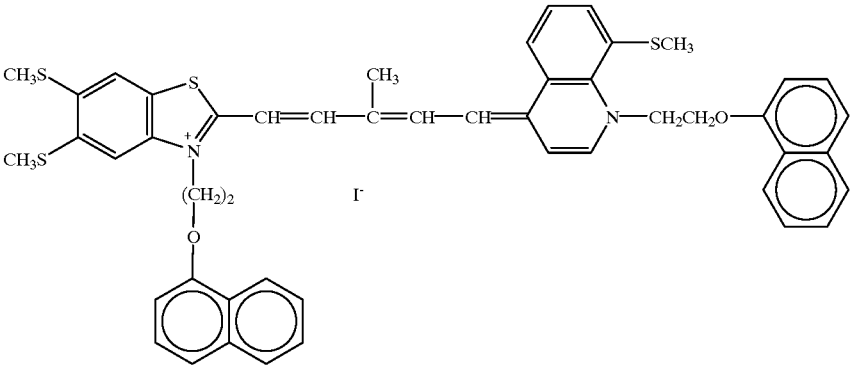
23.
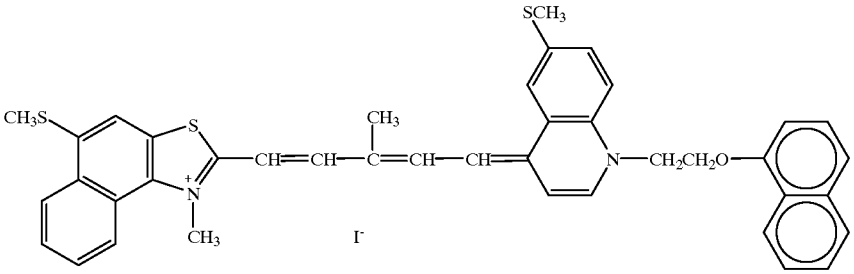

-continued
24.
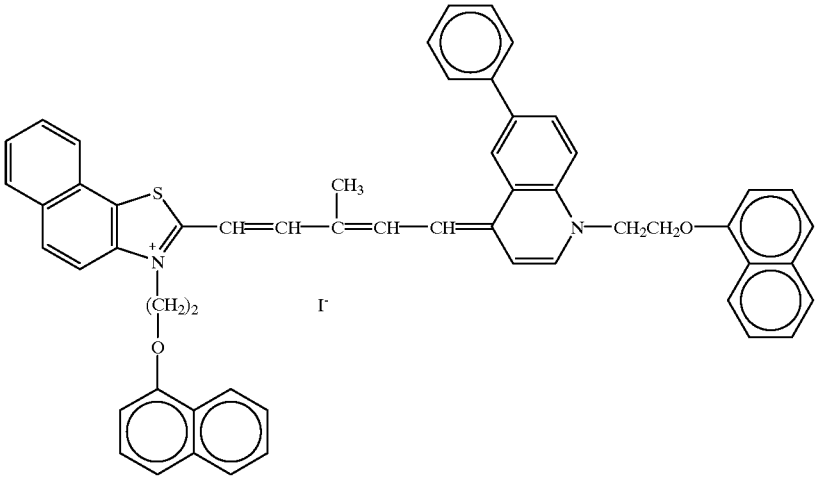
25.
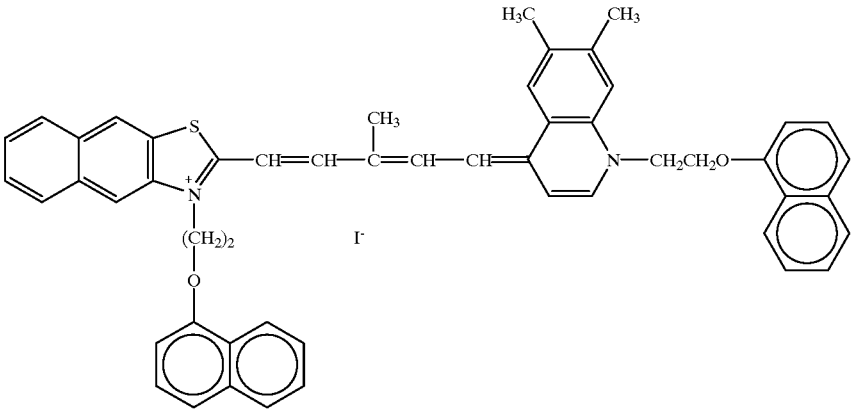
26.
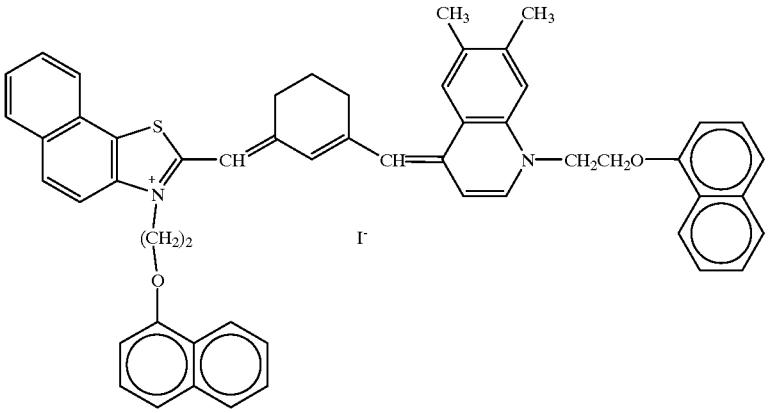

-continued
27.
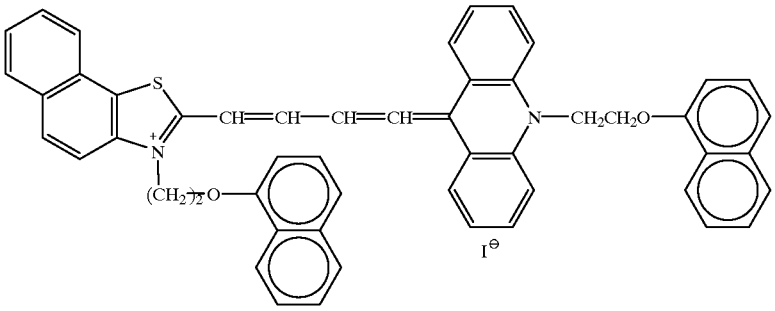
28.
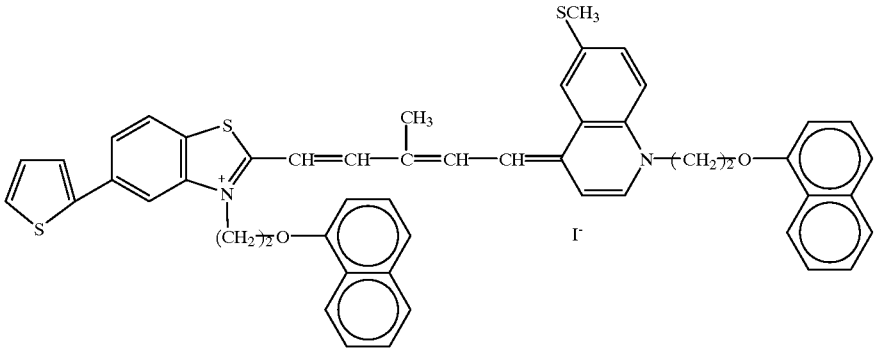
29.
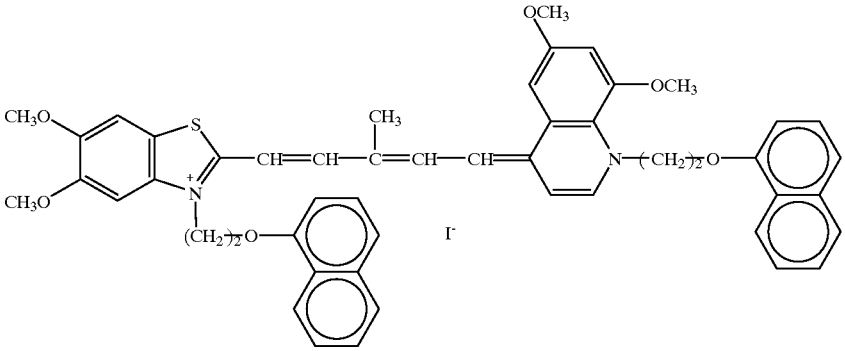
30.
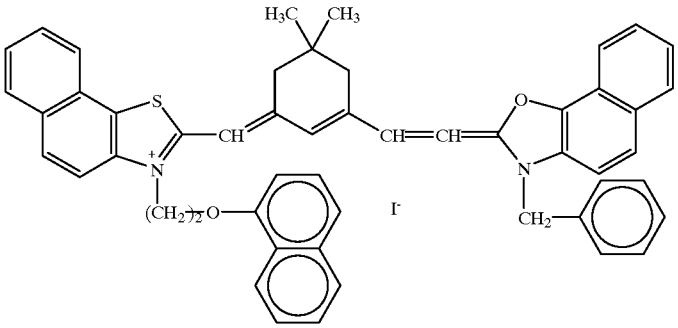

-continued
31.
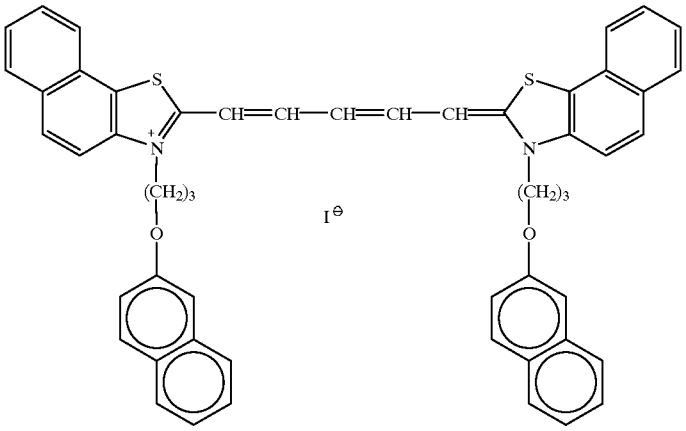
32.
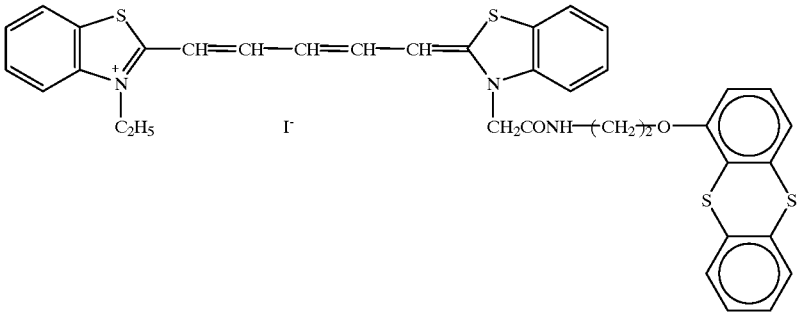
33.
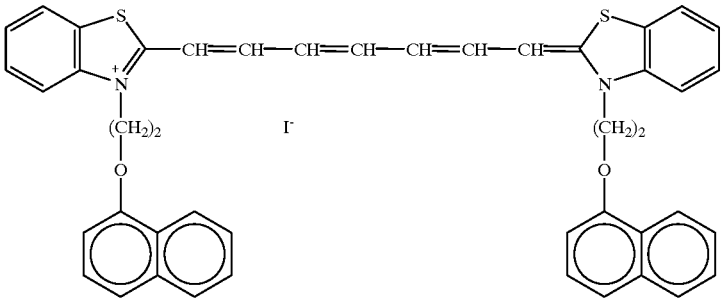
34.
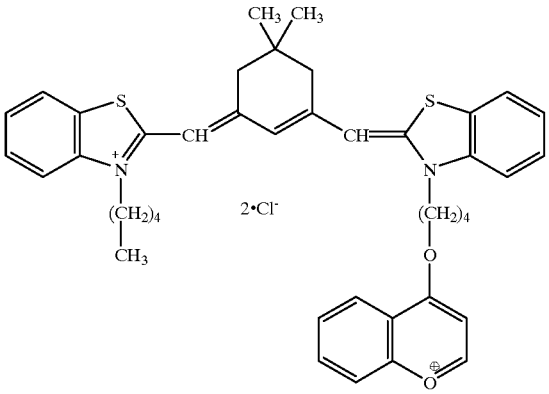

-continued
35.
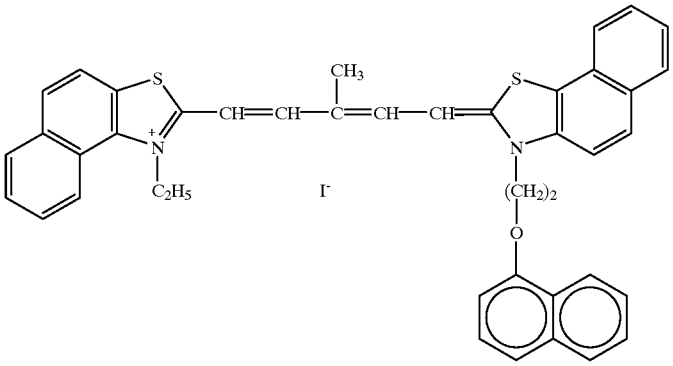
36.
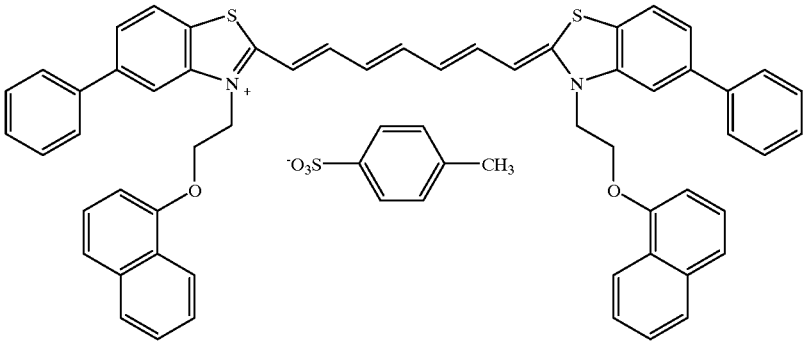
37.
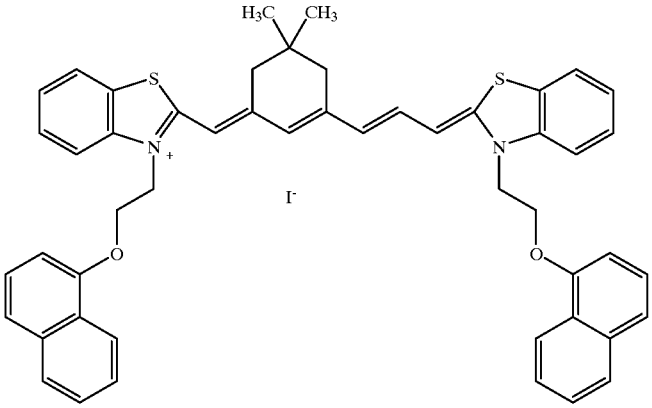
38.
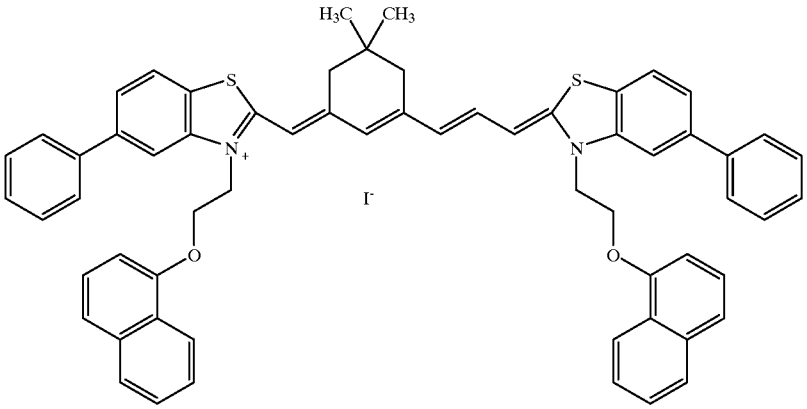

-continued
39.
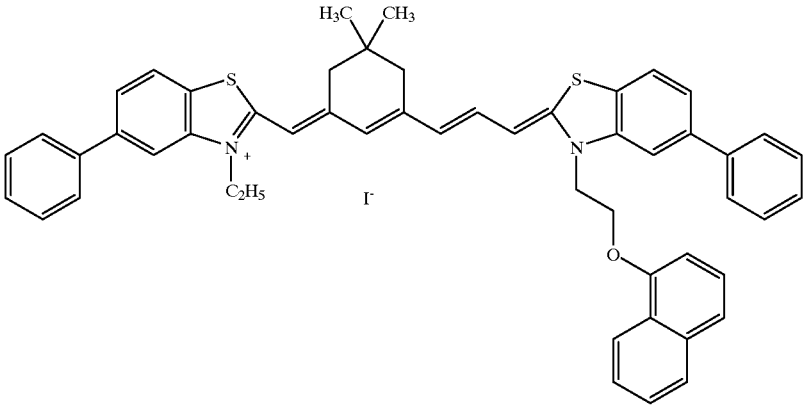
40.
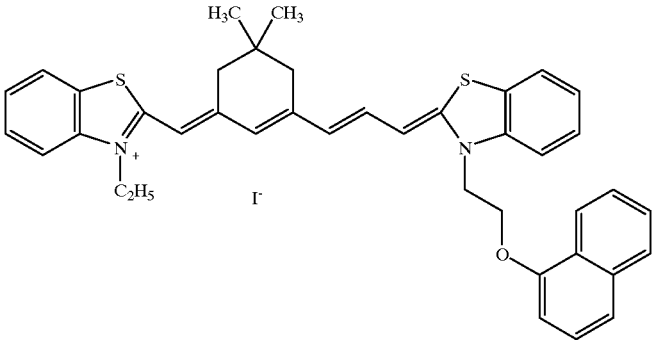
41.
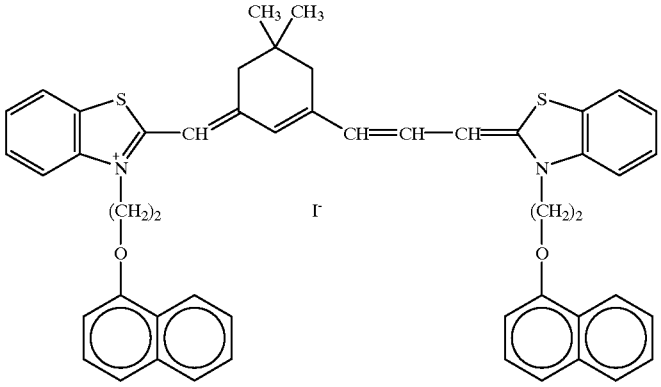
42.
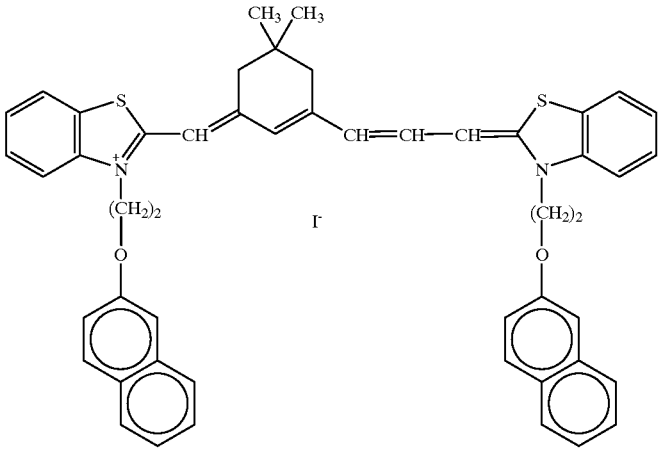

-continued
43.
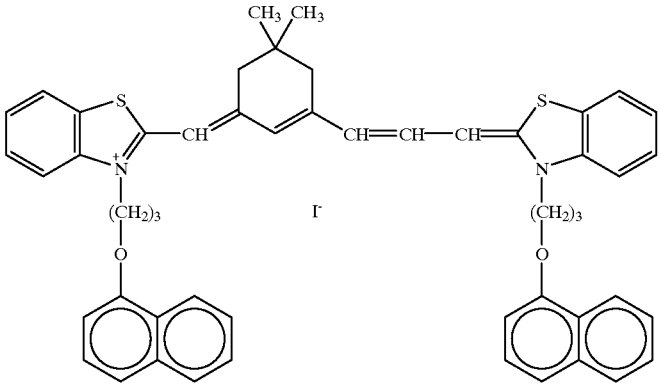
44.
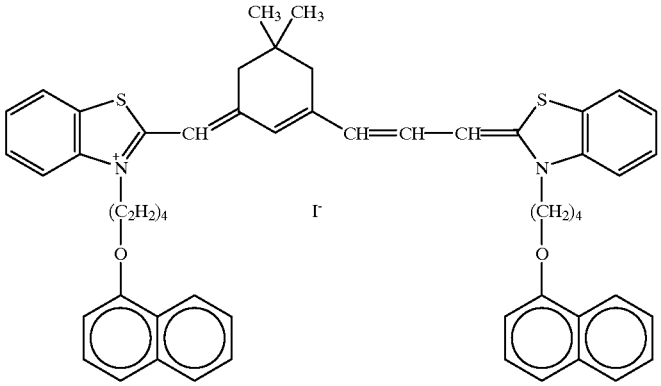
45.
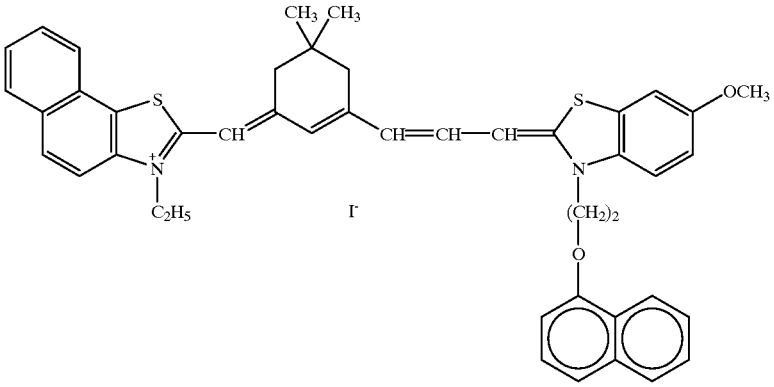
46.
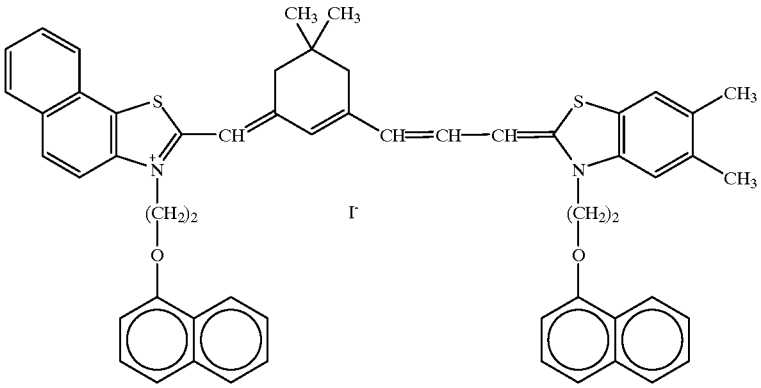

-continued
47.
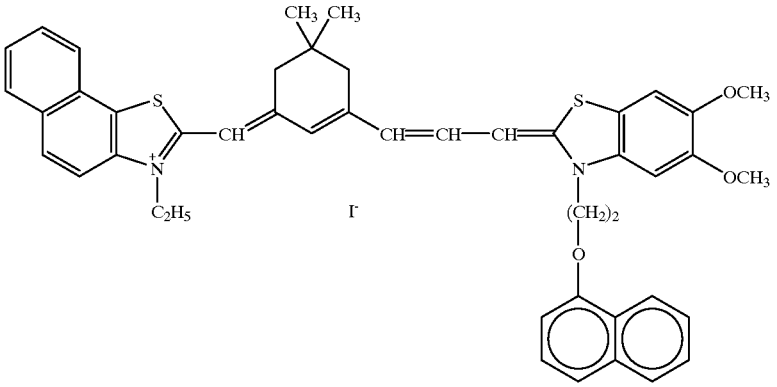
48.
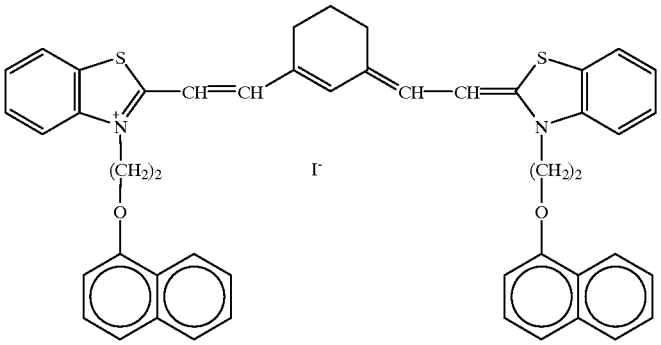
49.
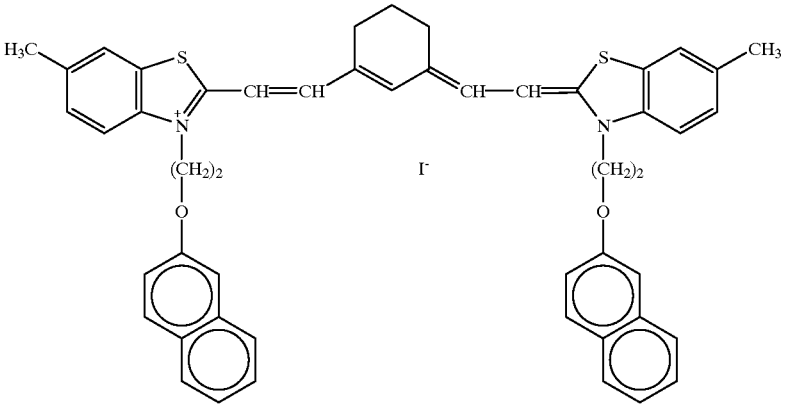
50.
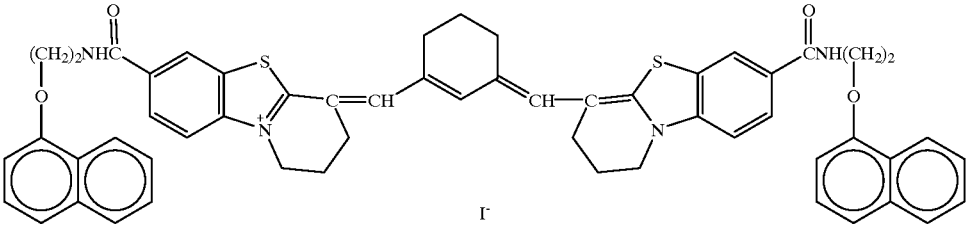

-continued
51.
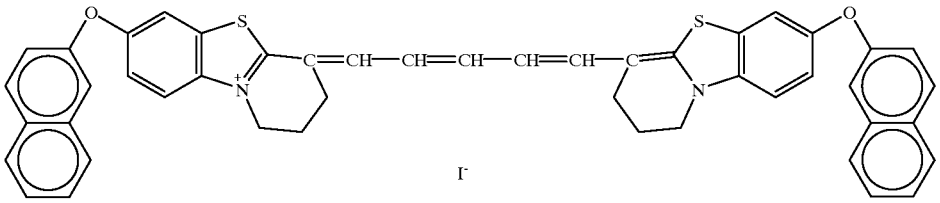
52.
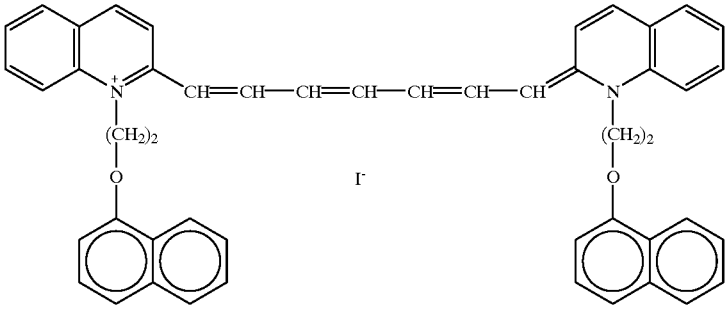
53.
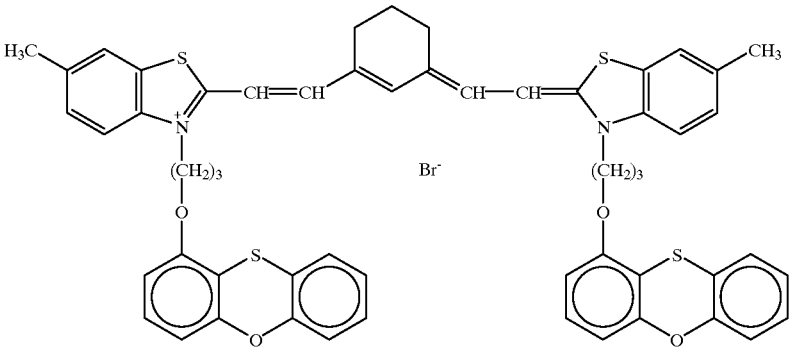
54.
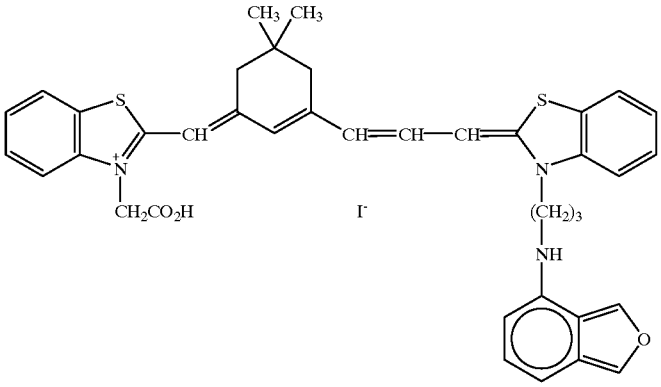

-continued
55.
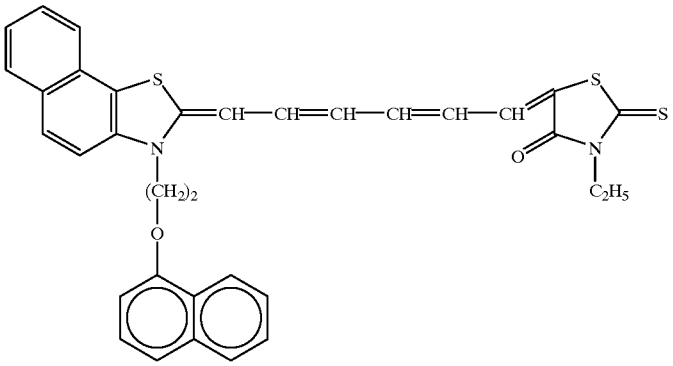
56.
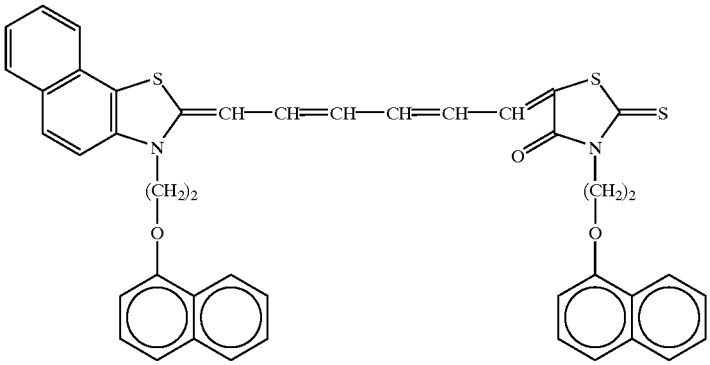
57.
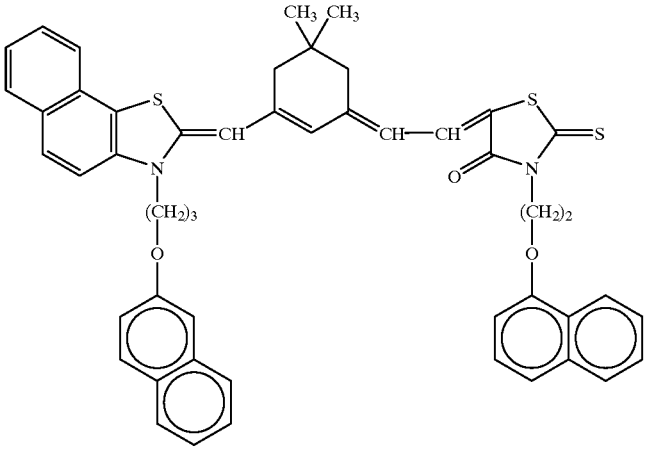
58.
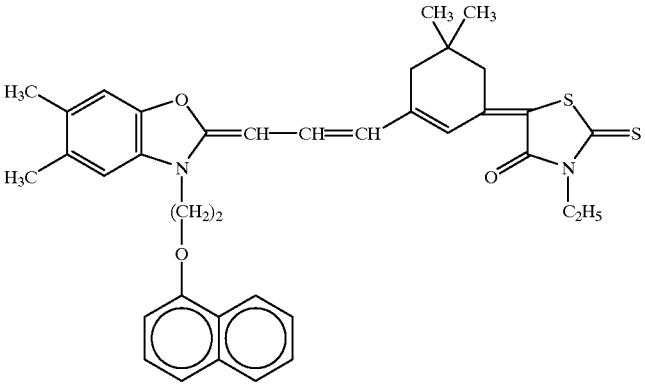

-continued
59.
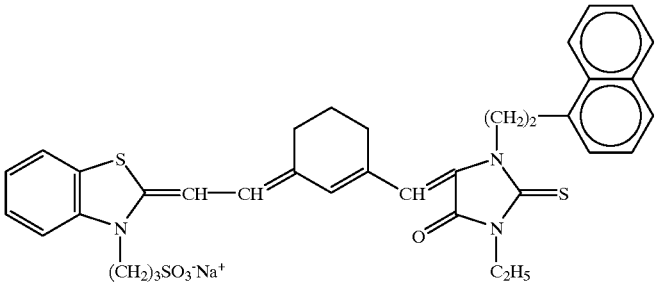
60.
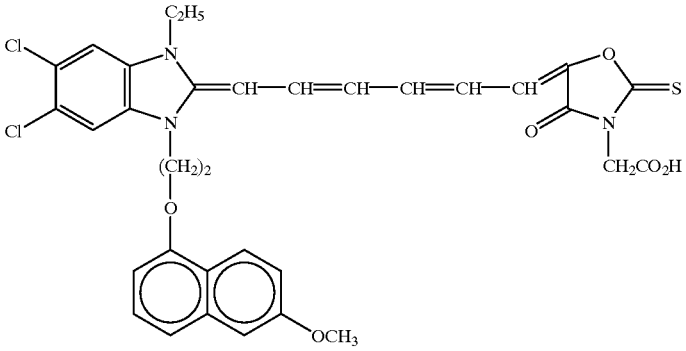
61.
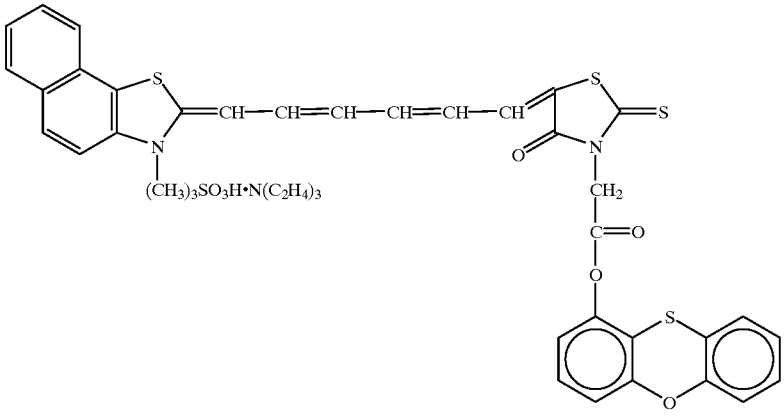
62.
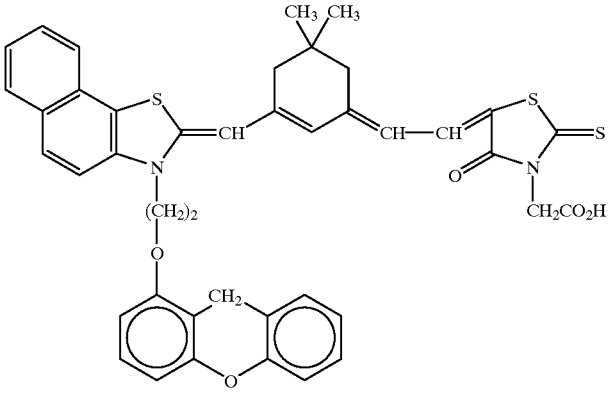
The polymethine dye represented by formula (I) for use in the present invention can be synthesized according to the methods described in the following publications:
a) F. M. Hamer, *Heterocyclic Compounds-Cyanine Dyes and Related Compounds*, John Wiley & Sons, New York, London (1964), b): D. M. Sturmer, *Heterocyclic Compounds-Special Topics in Heterocyclic Chemistry*, Chapter 8, Paragraph 4, pp. 482–515, John Wiley & Sons, New York, London (1977), c) *Zh. Org. Khim.*, Vol. 17, No. 1, pp. 167–169 (1981), ibid., Vol. 15, No. 2, pp. 400–407 (1979), ibid., Vol. 14, No. 10, pp. 2214–2221 (1978), ibid., Vol. 13, No. 11, pp. 2440–2443 (1977), ibid., Vol. 19, No. 10, pp. 2134–2142 (1982), *UKr. Khim. Zh.*, Vol. 40, No. 6, pp. 625–629 (1974), *Khim. Geterotsikl. Soedin.*, No. 2, pp. 175–178 (1978), Russian Patent Nos. 420,643 and 341,823, JP-A-59-217761, U.S. Pat. Nos. 4,334,000, 3,671,648, 3,623,881 and 3,573,921, Unexamined European Patent Publication Nos. 288,261A1, 102, 781A2 and 102,781A2, JP-B-49–46930 and JP-A-3-243944.

Specific examples of the synthesis method of the compound represented by formula (I) for use in the present invention are described below.

SYNTHESIS EXAMPLE 1

Synthesis of Compound 29:

1.18 g of 2-(3-ethoxy-3-methyl-2-propenyl)-5,6-dimethoxy-3-[2-(1-naphthoxy)ethyl]benzothiazolium iodide salt and 1.09 g of 6,8-dimethoxy-4-methyl-1-[2-(1-naphthoxy)ethyl]quinolinium paratoluene sulfonate were mixed with 10 ml of methyl alcohol, and thereto 1 ml of triethylamine was added. The reaction solution was heated under reflux for 5 minutes and then left standing to cool to room temperature. The crystals produced were collected by filtration and washed with methyl alcohol to obtain Compound 29.

λmax(MeOH)=759 nm

SYNTHESIS EXAMPLE 2

Synthesis of Compound 36:

1.7 g of 2-methyl-3-[2-(1-naphthoxy)ethyl]-5-phenylbenzothiazolium paratoluene sulfonate and 0.43 g of 1,7-diphenyl-1,7-diaza-1,3,5-heptatriene hydrochloride were dissolved in 15 ml of pyridine. Thereto, 1.4 ml of triethylamine was added, and then 0.5 ml of acetic anhydride was added. The reaction solution was stirred at room temperature for 1 hour, and 50 ml of ethyl acetate was added thereto. The crude crystals produced were collected by filtration and then recrystallized from DMF and methyl alcohol to obtain 0.35 g of Compound 36.

λmax(MeOH)=779 nm

SYNTHESIS EXAMPLE 3

Synthesis of Compound 37:

9.8 g of 2-methyl-3-[-2-(1-naphthoxy)ethyl]benzothiazolium paratoluene sulfonate, 6 ml of isophorone, 2 g of ammonium acetate and 6.8 ml of acetic acid were dissolved in 50 ml of toluene, and the mixture was heated under reflux for 2 hours while removing water by azeotropy. After leaving the solution standing to cool to room temperature, 50 ml of water was added. The resulting solution was extracted by 50 ml of methylene chloride, 10 g of sodium iodide was added, and the mixture was stirred. The organic layer was dried over sodium sulfate, the solvent was distilled off, 30 ml of ethyl acetate was added, and 10.1 g of 3-[2-(1-(naphthoxy)ethyl]-2-(3,5,5-trimethyl-2-cyclohexenylidene)methylbenzothiazolium iodide salt produced as a solid was collected by filtration. 5.7 g of the solid obtained and 4.9 g of 1,3-diphenyl-1,3-diazapropene were dissolved in 20 ml of acetic anhydride, the reaction solution was heated under reflux for 4 hours and then left standing to cool to room temperature, 30 ml of ethyl acetate was added, and 5.0 g of 3-[2-(1-naphthoxy)ethyl]-2-[3-(2-acetoanilidoethenyl)-5,5-dimethyl-2-cyclohexenylidene]methylbenzothiazolium iodide salt produced as a solid was collected by filtration. 2.5 g of the solid obtained and 1.7 g of 2-methyl-3-[2-(1-naphthoxy)-ethyl]benzothiazolium paratoluene sulfonate were dissolved in 15 ml of pyridine at 80° C., and thereto 4 ml of triethylamine was added. The reaction solution was stirred at room temperature for 1.5 hours, and 50 ml of ethyl acetate was added thereto. The crude crystals produced were collected by filtration and then recrystallized from methylene chloride and methyl alcohol to obtain 0.65 g of Compound 37.

λmax(MeOH)=771 nm

SYNTHESIS EXAMPLE 4

Synthesis of Compound 38:

11.3 g of 2-methyl-3-[2-(1-naphthoxy)ethyl]-5-phenylbenzothiazolium paratoluene sulfonate, 6 ml of isophorone, 2 g of ammonium acetate and 6.8 ml of acetic acid were dissolved in 50 ml of toluene and then heated under reflux for 3.5 hours while removing water by azeotropy. After leaving the solution standing to cool to room temperature, 50 ml of water was added. The resulting solution was extracted by 50 ml of methylene chloride, 10 g of sodium iodide was added, and the mixture was stirred. The organic layer was dried over sodium sulfate, the solvent was distilled off, 30 ml of ethyl acetate was added, and 8.6 g of 3-[2-(1-(naphthoxy)ethyl]-2-(3,5,5-trimethyl-2-cyclohexenylidine)methyl-5-phenylbenzothiazolium iodide salt produced as a solid was collected by filtration. 4.5 g of the solid obtained and 3.4 g of 1,3-diphenyl-1,3-diazapropene were dissolved in 25 ml of acetic anhydride, the reaction solution was heated under reflux for 2 hours and then left standing to cool to room temperature, 40 ml of ethyl acetate was added, and 3.4 g of 3-[2-(1-naphthoxy)ethyl]-2-[3-(2-acetoanilidoethenyl)-5,5-dimethyl-2-cyclohexenylidene]methyl-5-phenylbenzothiazolium iodide salt produced as a solid was collected by filtration. 2.0 g of the solid obtained and 1.4 g of 2-methyl-3-[2-(1-naphthoxy)ethyl]-5-phenylbenzothiazolium paratoluene sulfonate were dissolved in 15 ml of pyridine at 80° C., and thereto 3 ml of triethylamine was added. The reaction solution was stirred at room temperature for 2 hours, and 50 ml of ethyl acetate was added thereto. The crude crystals produced were collected by filtration and then recrystallized from methylene chloride and methyl alcohol to obtain 1.08 g of Compound 38.

λmax(MeOH)=784 nm

SYNTHESIS EXAMPLE 5

Synthesis of Compound 39:

4.3 g of 3-ethyl-2-methyl-5-phenylbenzothiazolium paratoluene sulfonate, 2.7 ml of isophorone, 1 g of ammonium acetate and 3.4 ml of acetic acid were dissolved in 35 ml of toluene and then heated under reflux for 1.5 hours while removing water by azeotropy. After leaving the solution standing to cool to room temperature, 50 ml of water was added. The resulting solution was extracted by 50 ml of methylene chloride, the organic layer was dried over sodium sulfate, the solvent was distilled off, 30 ml of ethyl acetate was added, and 4.7 g of 3-ethyl-2-(3,5,5-trimethyl-2-cyclohexenylidene)methyl-5-phenylbenzothiazolium paratoluene sulfonate produced as a solid was collected by filtration. 4.7 g of the solid obtained and 4.2 g of 1,3-diphenyl-1,3-diazapropene were dissolved in 20 ml of acetic anhydride, the reaction solution was heated under reflux for 8 hours and then left standing to cool to room temperature, 5 g of sodium iodide and 50 ml of water were added, and the resulting solution was extracted by methylene chloride. The organic layer was dried over sodium sulfate and the solvent was distilled off to obtain 2.9 g of 3-ethyl-2-[3-(2-acetanilidoethenyl)-5,5-dimethyl-2-cyclohexenylidene] methyl-5-phenylbenzothiazolium iodide salt as a solid. 0.7 g of the solid obtained and 0.6 g of 2-methyl-3-[2-(1-naphthoxy)ethyl]-5-phenylbenzothiazolium paratoluene sulfonate were dissolved in 10 ml of pyridine at 80° C., and thereto 1 ml of triethylamine was added. The reaction solution was stirred at room temperature for 1 hour, and 30 ml of ethyl acetate was added thereto. The crude crystals produced were collected by filtration and then recrystallized from methylene chloride and isopropyl alcohol to obtain 0.2 g of Compound 39.

λmax(MeOH)=779 nm

SYNTHESIS EXAMPLE 6

Synthesis of Compound 40:

1.3 g of 2-methylbenzothiazole and 3.7 g of 2-(1-naphthoxy)ethyl paratoluene s-ulfonate were stirred under heating at 160° C. for 4.5 hours. The mixture was cooled to room temperature, and thereto 3 g of 3-ethyl-2-(3,5,5-trimethyl-2-cyclohexenylidene)methylbenzothiazolium iodide salt was added. The resulting mixture was dissolved in 20 ml of pyridine on a steam bath, and thereto 2.3 ml of triethylamine was added. The reaction solution was stirred for 20 minutes on the steam bath, and thereto 30 ml of ethyl acetate was added. The crude crystals produced were collected by filtration and then recrystallized from methylene chloride and methyl alcohol to obtain 1.1 g of Compound 40.

λmax(MeOH)=766 nm

The cyanine dye represented by formula (I) of the present invention is preferably used in an amount of from $10^{-6}$ to 1 mol, more preferably from $10^{-5}$ to $10^{-2}$ mol, per mol of silver halide.

The methine dye for use in the present invention may be added in any step between the formation of silver halide and immediately before the coating, however, it is preferably added immediately before coating.

A plurality of methine dyes for use in the present invention may be used in combination to obtain a desired spectral sensitization spectrum.

The photothermographic material of the present invention comprises a support containing thereon a light-sensitive silver halide, a light-insensitive organic silver salt, a reducing agent for silver ion and a binder. The photothermographic material of the present invention preferably contains additional desired materials such as a color toning agent, a covering aid and other auxiliaries. The two-layer structure must be such that the first emulsion layer (usually, a layer adjacent to the base material) contains an organic silver salt and silver halide and the second layer or the first and second both layers contain other components. However, a two-layer structure comprising a single emulsion layer containing all components and a protective topcoat may also be used. The multi-color light-sensitive heat-developable photographic material may have a structure such that the above-described two-layer combination is used for respective colors or all components are contained in a single layer as described in U.S. Pat. No. 4,708,928. In the case of a multi-dye multi-color light-sensitive heat-developable photographic material, respective emulsion layers are generally divided from each other and held by providing a functional or non-functional barrier layer between respective light-sensitive layers as described in U.S. Pat. No. 4,460,681.

A plurality of sensitizing dyes for use in the present invention may be used in combination to obtain a desired spectral sensitization spectrum.

As the sensitizing dye for use in the present invention, a dye having a structure other than formula (I) may also be used in combination. The dye used in combination adsorbs to a silver halide grain and spectrally sensitizes the silver halide grain to the light having a wavelength in the region of preferably from 600 to 1,400 nm, more preferably from 750 to 1,400 nm. More specifically, the light-sensitive silver halide can be advantageously spectrally sensitized by various known dyes including a acyanine dye, a merocyanine dye, a styryl dye, a hemicyanine dye, an oxonol dye, a hemioxonol dye and a xanthene dye. Useful cyanine dyes are cyanine dyes having a basic nucleus such as a thiazoline nucleus, an oxazoline nucleus, a pyrroline nucleus, a pyridine nucleus, an oxazole nucleus, a thiazole nucleus, a selenazole nucleus and an imidazole nucleus. Preferred examples of useful merocyanine dyes include, in addition to those having the above-described basic nucleus, dyes having an acidic nucleus such as a thiohydantoin nucleus, a rhodanine nucleus, an oxazolidinedione nucleus, a thiazolinedione nucleus, a barbituric acid nucleus, a thiazolinone nucleus, a malononitrile nucleus and a pyrazolone nucleus. In particular, the dye used in combination may be appropriately selected from known dyes described in U.S. Pat. Nos. 3,761,279, 3,719,495 and 3,877,943, British Patents 1,466,201, 1,469,117 and 1,422,057, JP-B-3-10391, JP-B-6-52387, JP-A-5-341432, JP-A-6-194781 and JP-A-6-301141. The dye used in combination may be used generally in an amount of from about 10 μmol to about 1 mol per mol of silver halide. Further, a plurality of dyes may be used in combination to obtain a desired spectral sensitization spectrum.

The photothermographic material of the present invention is preferably a so-called one side light-sensitive material where light-sensitive layers containing at least one silver halide emulsion layer are provided on one side of the support and a backing layer on the other side.

The method of forming light-sensitive silver halide for use in the present invention is well known in the art and, for example, the methods described in *Research Disclosure*, No. 17029 (June, 1978) and U.S. Pat. No. 3,700,458 may be used. Specific examples of the method which can be used in the present invention include a method of adding a halogen-containing compound to an organic silver salt prepared to thereby convert a part of silver of the organic silver salt into light-sensitive silver halide and a method of adding a silver-supplying compound and a halogen-supplying compound to gelatin or other polymer solution to thereby prepare light-sensitive silver halide grains and mixing the grains with organic silver salt. The latter method is preferred in the present invention. The light-sensitive silver halide grain is preferably small in size so as to suppress low the white turbidity after formation of an image, specifically, the grain size is preferably 0.20 μm or less, more preferably from 0.01 to 0.15 μm, still more preferably from 0.02 to 0.12 μm. The term "grain size" as used herein means, in the case of a regular crystal-form, namely, cubic or octahedral, silver halide grain, the length of an edge of 5the silver halide grain; in the case of a tabular silver halide grain, the diameter of a circle image having the same area of the projected area of the main surface plane; and in the case of other irregular crystal-form, for example, spherical or stick-form, silver halide grains, the diameter of a sphere having the same volume as the grain.

Examples of the shape of the light-sensitive silver halide grain for use in the present invention include cubic form, octahedral form, tabular form, spherical form, stick form and bebble form, and among these, cubic grain and tabular grain are preferred in the present invention. When a tabular silver halide grain is used, the average aspect ratio is preferably from 100:1 to 2:1, more preferably from 50:1 to 3:1. A silver halide grain having rounded corners is also preferably used. The face index (Miller indices) of the outer surface plane of a light-sensitive silver halide grain is not particularly limited, however, it is preferred that the occupation of [100] faces giving a high spectral sensitization efficiency upon adsorption of the spectral sensitizing dye is high. The occupation ratio is preferably 50% or more, more preferably 65% or more, still more preferably 80% or more. The percentage of [100] faces according to the Miller indices can be obtained by the method described in T. Tani, *J. Imaging Sci.*, 29, 165 (1985) using the adsorption dependency of [111] face and [100] face upon adsorption of the sensitizing dye. The halogen composition of the light-sensitive silver halide is not particularly limited, and any of silver chloride, silver chlorobromide, silver bromide, silver iodobromide, silver iodochlorobromide and silver iodide may be used, however, silver bromide and silver iodobromide may be preferably used in the present invention. Silver iodobromide is more preferred, and the silver iodide content is preferably from 0.1 to 40 mol %, more preferably from 0.1 to 20 mol %. The halogen composition distribution within the grain may be uniform or the halogen composition may be stepwise changed or continuously changed. One preferred example is a silver iodobromide grain having a high silver iodide content inside the grain. A silver halide grain having a core/shell structure may also be preferably used. With respect to the structure, core/shell grains having from 2 to 5-ply structure, more preferably from 2 to 4-ply structure are preferred.

The light-sensitive silver halide grain for use in the present invention preferably contains at least one metal complex selected from the group consisting of rhodium, rhenium ruthenium, osnium, iridium, cobalt and iron. One kind of metal complex may be used or two or more complexes of the same kind of metal or different kinds of metals may also be used in combination. The metal complex content is preferably from 1 nmol to 10 mmol, more preferably from 10 nmol to 100 $\mu$mol. With respect to the specific structure of the metal complex, the metal complexes having the structures described in JP-A-7-225449 may be used. In the case of a cobalt or iron compound, a hexacyano metal complex is preferably used. Specific examples thereof include ferricyanate ion, ferrocyanate ion and hexacyanocobalt ion, however, the present invention is by no means limited thereto. The phase of the silver halide, in which the metal complex is contained, is not particularly limited, and the phase may be uniform or the metal complex may be contained in a higher concentration in the core part or in the shell part.

The light-sensitive silver halide grain may be desalted by water washing according to the method known in the art, such as noodle washing and flocculation, but may not be desalted in the present invention.

The light-sensitive silver halide grain for use in the present invention is preferably subjected to chemical sensitization. The chemical sensitization is preferably performed using sulfur sensitization, selenium sensitization or tellurium sensitization as is well known in the art. Further, noble metal sensitization using, for example, a gold compound or a platinum, palladium or iridium compound, or reduction sensitization may also be used. The compound preferably used in the sulfur sensitization, selenium sensitization or tellurium sensitization may be a known compound, but the compounds described in JP-A-7-128767 may be used. Examples of the tellurium sensitizer include diacyl tellurides, bis(oxycarbonyl) tellurides, bis(carbamoyl) tellurides, bis(oxycarbonyl) ditellurides, bis(carbamoyl) ditellurides, compounds having P=Te bond, tellurocarboxylates, Te-organyltellurocarboxylates, di(poly) tellurides, tellurides, tellurols, telluroacetals, tellurosulfonates, compounds having P-Te bond, Te-containing heterocyclic rings, tellurocarbonyl compounds, inorganic tellurium compounds and colloidal tellurium. Examples of the compound preferably used in the noble metal sensitization include chloroauric acid, potassium chloroaurate, potassium aurithiocyanate, gold sulfide, gold selenide and the compounds described in U.S. Pat. No. 2,448,060 and British Patent 618,061. Specific examples of the compound used in the reduction sensitization include an ascorbic acid, thiourea dioxide, stannous chloride, aminoiminomethanesulfinic acid, a hydrazine derivative, a borane compound, a silane compound and a polyamine compound. The reduction sensitization may be performed by ripening the grains while keeping the emulsion at a pH of 7 or more, or at a pAg of 8.3 or less. Further, the reduction sensitization may also be performed by introducing a single addition part of silver ion during the formation of grains.

The light-sensitive silver halide for use in the present invention is preferably used in an amount of from 0.01 to 0.5 mol, more preferably from 0.02 to 0.3 mol, still more preferably from 0.03 to 0.25 mol, per mol of the organic silver salt. The mixing method or mixing conditions of light-sensitive silver halide and organic silver salt which are prepared individually are not particularly limited as long as the effect of the present invention can be obtained satisfactorily, however, a method of mixing the silver halide grains and the organic silver salt each after completion of the preparation, in a ball mill, a sand mill, a colloid mill, a vibration mill or a homogenizer, or a method of preparing organic silver salt while mixing light-sensitive silver halide after completion of the preparation in any timing during preparation of the organic silver salt, may be used.

The light-insensitive organic silver salt which can be used in the present invention is a silver salt which is relatively stable against light but forms a silver image when it is heated at 80° C. or higher in the presence of an exposed photocatalyst (e.g., a latent image of light-sensitive silver halide) and a reducing agent. The organic silver salt may be any organic substance containing a source capable of reducing the silver ion. A silver salt of an organic acid, particularly a silver salt of a long chained (having from 10 to 30, preferably from 15 to 28 carbon atoms) aliphatic carboxylic acid, is preferred. A complex of an organic or inorganic silver salt, of which ligand has a complex stability constant of from 4.0 to 10.0, is also preferred. The silver-supplying substance may constitute preferably from about 5 to 30 wt % of the image forming layer. The preferred organic silver salt includes a silver salt of an organic compound having a carboxyl group. Examples thereof include an aliphatic carboxylic acid silver salt and an aromatic carboxylic acid silver salt, however, the present invention is by no means limited thereto. Preferred examples of the aliphatic carboxylic acid silver salt include silver behenate, silver stearate, silver oleate, silver laurate, silver caproate, silver myristate, silver palmitate, silver maleate, silver fumarate, silver tartrate, silver linoleate, silver butyrate, silver camphorate and a mixture thereof.

A silver salt of a compound having a mercapto group or a thione group and a derivative thereof may also be used. Preferred examples of the compound include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido)

benzo-thiazole, a silver salt of a thioglycolic acid such as S-alkylthioglycolic acid (in which the alkyl group has from 12 to 22 carbon atoms), a silver salt of a dithiocarboxylic acid such as dithioacetic acid, a silver salt of thioamide, a silver salt of 5-carboxyl-1-methyl-2-phenyl-4-thiopyridine, a silver salt of mercaptotriazine, a silver salt of 2-mercaptobenzoxazole, silver salts described in U.S. Pat. No. 4,123,274, for example, a silver salt of a 1,2,4-mercaptothiazole derivative such as 3-amino-5-benzylthio-1,2,4-thiazole, and a silver salt of a thione compound such as 3-(3-carboxyethyl)-4-methyl-4-thiazoline-2-thione described in U.S. Pat. No. 3,301,678. Further, a compound having an imino group may be used. Preferred examples of this compound include a silver salt of benzotriazole and a derivative thereof such as silver salt of a benzotriazole (e.g., silver benzotriazole) and silver salt of a halogen-substituted benzotriazole (e.g., silver 5-chlorobenzotriazole), a silver salt of 1,2,4-triazole or 1-H-tetrazole described in U.S. Pat. No. 4,220,709, and a silver salt of imidazole or an imidazole derivative. Furthermore, various silver acetylide compounds described in U.S. Pat. Nos. 4,761,361 and 4,775,613 may be used.

The shape of the organic silver salt which can be used in the present invention is not particularly limited, but an acicular crystal form having a short axis and a long axis is preferred. The relationship of reverse proportion between the size of a silver salt crystal grain and the covering force thereof, which is well known in the field of light-sensitive silver halide materials, also applies to the photothermographic material of the present invention. That is, when the organic silver salt grain as the image formation part of the photothermographic material is large in the size, the covering force is weak and the image density becomes low. Accordingly, the size of the organic silver salt needs be small. In the present invention, the short axis is preferably from 0.01 to 0.20 $\mu$m, more preferably from 0.01 to 0.15 $\mu$m, and the long axis is preferably from 0.10 to 5.0 $\mu$m, more preferably from 0.10 to 4.0 $\mu$m. The grain size distribution of the organic silver salt is preferably monodisperse. The term "monodisperse" as used herein means that the percentage of the value obtained by dividing the standard deviation of the length of the short axis or the long axis by the length of the short axis or the long axis, respectively, is preferably 100% or less, more preferably 80% or less, still more preferably 50% or less. The shape of the organic silver salt can be determined by the image of an organic silver salt dispersion observed through a transmission type electron microscope. Another method of determining the monodispersibility is a method of obtaining the standard deviation of a volume load average diameter of the organic silver salt, wherein an organic silver salt dispersed, for example, in a solution is irradiated by laser light, an autocorrelation function to the change in the fluctuation time of scattered light is obtained, and the grain size (volume load average diameter) is determined therefrom. The percentage (coefficient of variation) of the value obtained by dividing the standard deviation by the volume load average diameter is preferably 100% or less, more preferably 80% or less, still more preferably 50% or less.

The organic silver salt for use in the present invention may be used in any desired amount, however, it is preferably used in an amount of from 0.1 to 5 g/m$^2$, more preferably from 1 to 3 g/m$^2$.

The reducing agent for silver ion may be any substance, preferably an organic substance, which reduces the silver ion to metal silver. Conventional photographic developers such as phenidone, hydroquinone and catechol are useful, however, a hindered phenol reducing agent is preferred. The reducing agent needs be present in an amount of from 1 to 10 wt % of the image forming layer. In the case of a multi-layer structure and adding the reducing agent to a layer other than an emulsion layer, the ratio of the reducing agent is slightly higher than the above-described range, preferably from about 2 to 15%.

Reducing agents over a wide range are disclosed for the photothermographic material using an organic silver salt: for example, amidoxime such as phenylamidoxime, 2-thienylamidoxime and p-phenoxyphenylamidoxime; azine such as 4-hydroxy-3,5-dimethoxybenzaldehyde azine; a combination of an aliphatic carboxylic acid arylhydrazide with an ascorbic acid such as a combination of 2,2-bis(hydroxymethyl)propionyl-β-phenylhydrazine with an ascorbic acid; a combination of polyhydroxybenzene with hydroxylamine, reductone and/or hydrazine such as a combination of hydroquinone with bis(ethoxyethyl) hydroxylamine, piperidinohexose reductone or formyl-4-methylphenylhydrazine; a hydroxamic acid such as phenylhydroxamic acid, p-hydroxyphenylhydroxamic acid and β-anilinehydroxamic acid; a combination of an azine with a sulfonamidophenol such as a combination of phenothiazine with phenothiazine with 2,6-dichloro-4-benzenesulfonamidophenol; an α-cyanophenylacetic acid derivative such as ethyl-α-cyano-2-methylphenylacetate and ethyl-α-cyanophenylacetate; a bis-1-naphthol such as 2,2-dihydroxy-l,1-binaphthyl, 6,6-dibromo-2,2-dihydroxy-1,1-binaphthyl and bis(2-hydroxy- 1-naphthyl)methane; a combination of a bis-β-naphthol with a 1,3-dihydroxybenzene derivative (e.g., 2,4-dihydroxybenzophenone, 2,4-dihydroxyacetophenone); 5-pyrazolone such as 3-methyl-1-phenyl-5-pyrazolone; a reductone such as dimethylaminohexose reductone, anhydrodihydroaminohexose reductone and anhydrodihydropiperidonehexose reductone; a sulfonamidophenol reducing agent such as 2,6-dichloro-4-benzenesulfonamidophenol and p-benzenesulfonamidophenol; 2-phenylindane-1,3-dione; a chroman such as 2,2-dimethyl-7-t-butyl-6-hydroxychroman; 1,4-dihydropyridine such as 2,6-dimethoxy-3,5-dicarboethoxy-1,4-dihydropyridine; a bisphenol such as bis(2-hydroxy-3-t-butyl-5-methylphenyl) methane, 2,2-bis(4-hydroxy-3-methylphenyl)-propane, 4,4-ethylidene-bis(2-t-butyl-6-methylphenol), 1,1-bis(2-hydroxy-3 , 5-dimethylphenyl)-3,5,5-trimethylhexane and 2,2-bis(3,5-dimethyl-4-hydroxyphenyl)propane; an ascorbic acid derivative such as 1-ascorbyl palmitate and ascorbyl stearate; an aldehyde and a ketone such as benzyl and biacetyl; 3-pyrazolidone and a certain kind of indane-1,3-dione; and chromanol (tocopherol). Particularly preferred reducing agents are bisphenol and chromanol.

In addition to the above-described compounds, an additive known as a "color toning agent" for improving the image is advantageously contained in some cases. For example, the color toner material may be present in an amount of from 0.1 to 10 wt % of the whole silver-holding components. The color toning agent is a material well known in the photographic technology as described in U.S. Pat. Nos. 3,080,254, 3,847,612 and 4,12–3,282.

Examples of the color toning agent include phthalimide and N-hydoxyphthalimide; a cyclic imide such as succinimide, pyrazolin-5-one, quinazolinone, 3-phenyl-2-pyrazolin-5-one, 1-phenylurazole, quinazoline and 2,4-thiazolidinedione; a naphthalimide such as N-hydroxy-1,8-naphthalimide; a cobalt complex such as cobalt hexaminetrifluoroacetate; a mercaptane such as 3-mercapto-1,2,4-triazole, 2,4-dimercaptopyrimidine, 3-mercapto-4,5-diphenyl-1,2,4-triazole and 2,5-dimercapto-1,3,4-thiadiazole; an N-(aminomethyl)aryldicarboxyimide such as (N,N-dimethylaminomethyl)phthalimide and N,N-(dimethylaminomethyl)-naphthalene-2,3-dicarboxyimide; a blocked pyrazole, an isothiuronium derivative and a certain kind of light discoloring agent, such as N-hexamethylenebis (1-carbamoyl-3,5-dimethylpyrazole), 1,8-(3,6-diazaoctane) bis(isothiuroniumacetate) and 2-tribromomehylsulfonyl) (benzothiazole); 3-ethyl-5-[(3-ethyl-2-benzothiazolinylidene)-1-methylethylidene]-2-thio-2,4-oxazolidinedione; a phthalazinone, a phthalazinone derivative or metal salt and a derivative (e.g., 4-(1-naphthyl) phthalazinone, 6-chlorophthalazinone, 5,7-dimethoxyphthalazinone, 2,3-dihydro-1,4-phthalazinedione); a combination of phthalazinone with a phthalic acid derivative (e.g., phthalic acid, 4-methylphthalic acid, 4-nitrophthalic acid, tetrachlorophthalic anhydride); a phthalazine, a phthalazine derivative or metal salt and a derivative (e.g., 4-(1-naphthyl) phthalazine, 6-chlorophthalazine, 5,7-dimethoxyphthalazine and 2,3-dihydrophthalazine; a combination of phthalazine with a phthalic acid derivative (e.g., phthalic acid, 4-methylphthalic acid, 4-nitrophthalic acid, tetrachlorophthalic anhydride); quinazolinedione, benzoxazine and naphthoxazine derivatives; a rhodium complex which functions not only as a color tone controlling agent but also as a source of halide ion for producing silver halide at the site, such as ammonium hexachlororhodate(III), rhodium bromide, rhodium nitrate and potassium hexachlororhodate (III); inorganic peroxide and persulfate such as ammonium peroxydisulfide and hydrogen peroxide; a benzoxazine-2,4-dione such as 1,3-benzoxazine-2,4-dione, 8-methyl-1,3-benzoxazine-2,4-dione and 6-nitro-1,3-benzoxazine-2,4-dione; a pyrimidine and an asymmetric triazine, such as 2,4-dihydroxypyrimidine and 2-hydroxy-4-aminopyrimidine, an azauracil and a tetraazapentalene derivative (e.g., 3,6-dimercapto-1,4-diphenyl-1H,4H-2,3a,5,6a-tetraazapentalene, 1,4-di(o-chlorophenyl)-3,6-dimercapto-1H,4H-2,3a,5,6a-tetraazapentalene).

The photothermographic material of the present invention may contain a mercapto compound, a disulfide compound or a thione compound for controlling the development by inhibiting or accelerating the development, for improving spectral sensitization efficiency or for improving the storability before or after the development.

The mercapto compound for use in the present invention may have any structure, however, preferably has a structure represented by Ar-SM or Ar-S-S-Ar, wherein M represents a hydrogen atom or an alkali metal atom, and Ar is an aromatic or condensed aromatic ring containing one or more nitrogen, sulfur, oxygen, selenium or tellurium atoms. Preferred examples of the heteroaromatic ring include benzimidazole, naphthimidazole, benzothiazole, naphthothiazole, benzoxazole, naphthoxazole, benzoslenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from the group consisting of halogen (e.g., Br, Cl), hydroxy, amino, carboxy, alkyl (e.g., alkyl having 1 or more, preferably from 1 to 4, carbon atoms) and alkoxy (e.g., alkoxy having 1 or more, preferably from 1 to 4, carbon atoms). Examples of the mercapto-substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiole, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiole, 2,3,5,6-tetrachloro-4-pyridinethiole, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole and 2-mercapto-4-phenyloxazole, however, the present invention is by no means limited thereto.

The above-described mercapto compound is preferably added to an emulsion layer in an amount of from 0.001 to 1.0 mol, more preferably from 0.01 to 0.3 mol, per mol of silver.

In the light-sensitive material of the present invention, a surface protective layer may be provided for the purpose of preventing adhesion of the image forming layer. The surface protective layer may use any adhesion preventing material. Examples of the adhesion preventing material include wax, silica particle, a styrene-containing elastomeric block copolymer (e.g., styrene-butadiene-styrene, styrene-isoprene-styrene), cellulose acetate, cellulose acetate butyrate, cellulose propionate and a mixture thereof.

The emulsion layer or the protective layer of the emulsion layer for use in the present invention may use a photographic element containing a light absorbing substance or a filter dye described in U.S. Pat. Nos. 3,253,921, 2,274,782, 2,527,583 and 2,956,789. Further, a dye described, for example, in U.S. Pat. No. 3,282,699 may be mordanted. The filter dye is preferably used in an amount such that the absorbance at the exposure wavelength is from 0.1 to 3, more preferably from 0.2 to 1.5.

The emulsion layer or the protective layer of the emulsion layer for use in the present invention may contain a delustering agent such as starch, titanium dioxide, zinc oxide, silica and polymer beads including beads described in U.S. Pat. Nos. 2,992,101 and 2,701,245. The matting degree of the emulsion surface may be any if stardust failure is not generated, however, it is preferably, in terms of a Beck smoothness, from 1,000 to 10,000 seconds, more preferably from 2,000 to 10,000 seconds.

The binder in the emulsion layer for use in the present invention may be any selected from well-known natural or synthetic resins such as gelatin, polyvinyl acetal, polyvinyl chloride, polyvinyl acetate, cellulose acetate, polyolefin, polyester, polystyrene, polyacrylonitrile and polycarbonate. Of course, a copolymer and a terpolymer are included. The polymer is preferably lipophilic, and particularly preferred are polyvinyl butyral, butylethyl cellulose, methacrylate copolymer, maleic anhydride ester copolymer, polystyrene and butadiene-styrene copolymer. These polymers may be used, if desired, in combination of two or more thereof. The polymer is used in an amount sufficiently large to hold the components therein, in other words, in an effective range to function as the binder. The effective range can be determined appropriately by one skilled in the art. As a standard for holding at least the organic silver salt, the ratio of the binder to the organic silver salt is preferably from 15:1 to 1:2, more preferably from 8:1 to 1:1.

The solvent used in coating the light-sensitive emulsion containing a light-insensitive organic silver salt and light-sensitive silver halide for use in the present invention, together with binder on a support, must be able to dissolve the binder used. Examples of the solvent include those described in *Shin-han Yozai Pocketbook* (*New Version, Sol-*

*vent Pocketbook*), Ohm Sha (1994), however, the present invention is by no means limited thereto. The solvent for use in the present invention preferably has a boiling point of from 40 to 180° C.

Specific examples of particularly preferred solvents include hexane, cyclohexane, toluene, methanol, ethanol, 2-propanol (i.e., isopropyl alcohol), butanol, 2-butanone (i.e., methyl ethyl ketone), methyl isobutyl ketone, cyclohexanone, acetone, ethyl acetate, butyl acetate, tetrahydrofuran, thiophene, 2,2,2-trifluoroethanol, 2,2,3,3-tetrafluoro-1-propanol, perfluoropentane, xylene, phenol anisole, dibutyl ether, t-butyl methyl ether, ethylene glycol diethyl ether, propylene glycol monomethyl ether, N,N-dimethylformamide, N,N-dimethylacetamide, N-methylpyrrolidone, tributyl phosphate, tricresyl phosphate, diethyl carbonate, chlorobenzene and 1,1,1-trichloroethane. These solvents may be used in combination of two or more thereof. In order to increase the solubility of the solute, a base or an acid, such as morpholine, triethylamine, perfluorotributylamine and acetic acid, may be added. The solvent may contain moisture.

The photothermographic material of the present invention is preferably a so-called one side light-sensitive material where light-sensitive layers containing at least one silver halide emulsion layer are provided on one side of the support and a backing layer on the other side.

The one side light-sensitive material of the present invention may contain a matting agent for improving the transportation property. The matting agent is generally fine particle of a water-insoluble organic or inorganic compound. The matting agent which can be used may be any matting agent well known in the art, for example, an organic matting agent described in U.S. Pat. Nos. 1,939,213, 2,701,245, 2,322,037, 3,262,782, 3,539,344 and 3,7&7,448, or an inorganic matting agent described in U.S. Pat. Nos. 1,260,772, 2,192,241, 3,257,206, 3,370,951, 3,523,022 and 3,769,020. Specific examples of the organic compound which can be preferably used as the matting agent include a water-dispersing vinyl polymer such as polymethyl acrylate, polymethyl methacrylate, polyacrylonitrile, acrylonitrile-α-methylstyrene copolymer, polystyrene, styrene-divinylbenzene copolymer, polyvinyl acetate, polyethylene carbonate and polytetrafluoroethylene; a cellulose derivative such as methyl cellulose, cellulose acetate and cellulose acetate propionate; a starch derivative such as carboxy starch, carboxynitrophenyl starch and urea-formaldehyde-starch reaction product; gelatin hardened by a known hardening agent, and hardened gelatin formed into a fine capsule hollow particle by coacervate hardening. Examples of the inorganic compound which can be preferably used include silicon dioxide, titanium dioxide, magnesium dioxide, aluminum oxide, barium sulfate, calcium carbonate, silver chloride desensitized by a known method, silver bromide desensitized by a known method, glass and diatomaceous earth. The above-described matting agents may be used in combination of different kinds of compounds, if desired. The matting agent is not particularly limited on the size and the shape and may have any particle size. In practicing the present invention, a matting agent having a particle size of from 0.1 to 30 μm is preferably used. The particle size distribution of the matting agent may be either narrow or broad. However, since the matting agent greatly affects the haze or surface gloss of the light-sensitive material, its particle size, shape and particle size distribution are preferably selected appropriately according to the use purpose.

The backing layer for use in the present invention preferably has a matting degree such that the Beck smoothness is from 10 to 250 seconds, more preferably from 50 to 180 seconds.

The matting agent for use in the present invention is preferably incorporated into the outermost surface layer, a layer which functions as the outermost surface layer, a layer close to the outer surface layer or a layer which acts as a so-called protective layer.

The binder suitable for the backing layer for use in the present invention is transparent or translucent and generally colorless. A natural polymer, a synthetic resin, polymer or copolymer or other film-forming medium may be used as such a binder, and examples thereof include gelatin, gum arabi, poly(vinyl alcohol), hydroxyethyl cellulose, cellulose acetate, cellulose acetate butyrate, poly(vinyl pyrrolidone), casein, starch, poly(acrylic acid), poly(methyl methacrylate), poly(vinyl chloride), poly(methacrylic acid), copoly(styrene-maleic anhydride), copoly(styrene-acrylonitrile), copoly(styrene-butadiene), poly(vinyl acetals) (e.g., poly(vinyl formal), poly(vinyl butyral)), poly (esters), poly(urethanes), phenoxy resin, poly(vinylidene chloride), poly(epoxides), poly(carbonates), poly(vinyl acetate), cellulose esters and poly(amides). The binder may also be formed by coating from water, an organic solvent or an emulsion.

The backing layer for use in the present invention preferably has an absorption maximum in the range of from 750 to 1,400 nm, of from 0.3 to 2, and more preferably has an IR absorption of from 0.5 to 2 and an absorption in the visible light region, of from 0.001 to less than 0.5. Still more preferably, the backing layer is an antihalation layer having an optical density of from 0.001 to less than 0.3.

When an antihalation dye is used in the present invention, the dye may be any compound as long as it achieves desired absorption in the range of from 750 to 1,400 nm, exhibits sufficiently low absorption in the visible light region and gives the above-described preferred absorption spectrum form to the backing layer. Examples of such an antihalation dye include the compounds described in JP-A-7-13295, U.S. Pat. No. 5,380,635, JP-A-2-68539, from page 13, left lower column, line 1 to page 14, left lower column, line 9, and JP-A-3-24539, from page 14, left lower column to page 16, right lower column, however, the present invention is by no means limited thereto.

A backside resistive heating layer disclosed in U.S. Pat. Nos. 4,460,681 and 4,374,921 may be used in the light-sensitive heat-developable photographic image system.

The silver halide emulsion and/or the organic silver salt for use in the present invention may be further protected against production of additional fogging or stabilized against reduction in the sensitivity during stock storage, by an antifoggant, a stabilizer or a stabilizer precursor. Examples of suitable antifoggants, stabilizers and stabilizer precursors which can be used individually or in combination, include thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechols described in U.S. Pat. No. 3,235,652, oximes, nitrons and nitroindazoles described in British Patent 623, 448, polyvalent metal salts described in U.S. Pat. No. 2,839,405, thiuronium salts described in U.S. Pat. Nos. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazines described in U.S. Pat. Nos. 4,128, 557, 4,137,079, 4,138,365 and 4,459,350, and phosphorus compounds described in U.S. Pat. No. 4,411,985.

The light-sensitive layer for use in the present invention may use, as a plasticizer or a lubricant, a polyhydric alcohol (for example, glycerines and diols described in U.S. Pat. No. 2,960,404), a fatty acid or ester described in U.S. Pat. Nos. 2,588,765 and 3,121,060, and a silicone resin described in British Patent 955,061.

The layers for use in the present invention such as the light-sensitive layer, the protective layer and the back layer, each may use a hardening agent. Examples of the hardening agent include polyisocyanates described in U.S. Pat. No. 4,281,060 and JP-A-6-20193, epoxy compounds described in U.S. Pat. No. 4,791,042, and vinyl sulfone-base compounds described in JP-A-62-89048.

In the present invention, a surface active agent may be used for the purpose of improving the static charge property. The surface active agent includes nonionic, anionic, cationic and fluorine-base surface active agents and any of these may be used appropriately as the surface active agent. Specific examples thereof include fluorine-base polymer surface active agents described in JP-A-62-170950 and U.S. Pat. No. 5,382,504, fluorine-base surface active agents described in JP-A-60-244945 and JP-A-63-188135, polysiloxane-base surface active agents described in U.S. Pat. No. 3,885,965, and polyalkylene oxides and anionic surface active agents described in JP-A-6-301140.

In the present invention, a hydrazine derivative may be used. The hydrazine derivative which can be used in the present invention include the compound represented by formula (I), specifically Compounds I-1 to I-53, of Japanese Patent Application No. 6-47961 (JP-A-7-287335).

The following hydrazine derivatives may also be preferably used:

the compound represented by (Chem. 1), specifically the compounds described in pages 3 and 4, of JP-B-6-77138; the compound represented by formula (I), specifically Compounds 1 to 38 described at pages 8 to 18, of JP-B-6-93082; the compounds represented by formulae (4), (5) and (6), specifically Compounds 4-1 to 4-10 described at pages 25 and 26, Compounds 5-1 to 5-42 at pages 28 to 36 and Compounds 6-1 to 6-7 at pages 39 and 40, of JP-A-6-230497; the compounds represented by formulae (1) and (2), specifically Compounds 1-1) to 1-17) and 2–1) described at pages 5 to 7, of JP-A-6-289520; the compounds represented by (Chem. 2) and (Chem. 3), specifically the compounds described at pages 6 to 19, of JP-A-6-313936; the compound represented by (Chem. 1), specifically the compounds described at pages 3 to 5, of JP-A-6-313951; the compound represented by formula (I), specifically Compounds I-1 to I-38 described at pages 5 to 10, of JP-A-7–5610; the compound represented by formula (II), specifically Compounds II-1 to II-102 described at pages 10 to 27, of JP-A-7-77783; the compounds represented by formulae (H) and (Ha), specifically Compounds H-1 to H-44 described at pages 8 to 15, of JP-A-7-104426; the compounds characterized by having, in the vicinity of the hydrazine group, an anionic group or a nonionic group which forms an intramolecular hydrogen bond with the hydrogen atom of hydrazine, and represented by formulae (A), (B), (C), (D), (E) and (F), specifically Compounds N-1 to N-30, of Japanese Patent Application No. 7–191007 (JP-A-9–22082); and the compound represented by formula (1), specifically Compounds D-1 to D-55, of Japanese Patent Application No. 7-191007.

When a hydrazine-base nucleating agent is used in the present invention, the nucleating agent may be dissolved in an appropriate water-miscible organic solvent before use, such as an alcohol (e.g., methanol, ethanol, propanol, fluorinated alcohol), a ketone (e.g., acetone, methyl ethyl ketone), dimethylformamide, dimethylsulfoxide or methyl cellosolve.

Further, the nucleating agent may be formed into an emulsion dispersion before use by an already well-known emulsion dispersion method, where the nucleating agent is dissolved using an oil such as dibutyl phthalate, tricresyl phosphate, glyceryl triacetate or diethyl phthalate or an auxiliary solvent such as ethyl acetate or cyclohexanone, and then mechanically emulsion dispersed. Furthermore, powder of a hydrazine derivative may be used by dispersing it in water using a ball mill, a colloid mill or ultrasonic waves by the method known as a solid dispersion method.

When a hydrazine-base nucleating agent is used in the present invention, it may be added to any of the above-described silver halide emulsion layer and other hydrophilic colloid layers on the silver halide emulsion layer side of the support, however, the nucleating agent is preferably added to the silver halide emulsion layer or a hydrophilic colloid layer adjacent thereto.

The nucleating agent for use in the present invention is preferably used in an amount of from 1 $\mu$mol to 10 mmol, more preferably from 10 $\mu$mol to 5 mmol, most preferably from 20 $\mu$mol to 5 mmol.

Although not necessary for practicing the present invention, mercury(II) salt as an antifoggant is sometimes advantageously added to the emulsion layer. Preferred examples of the mercury(II) salt to this effect include mercury acetate and mercury bromide.

The photographic emulsion for heat development for use in the present invention may be coated on a support of various types. Typical examples of the support include a polyester film, an undercoated polyester film, a poly (ethylene terephthalate) film, a polyethylene naphthalate film, a cellulose nitrate film, a cellulose ester film, a poly (vinyl acetal) film, a polycarbonate film and a material relevant thereto or in the resin form, glass, paper and metal. Typically used is a flexible base material, particularly a paper support coated by a partially acetylated or baryta and/or $\alpha$-olefin polymer, preferably by a polymer of $\alpha$-olefin polymer having from 2 to 10 carbon atoms, such as polyethylene, polypropylene or ethylene-butene copolymer. The support may or may not be transparent, but preferably transparent.

The light-sensitive material of the present invention may have an antistatic or electrically conductive layer, for example, a soluble salt (e.g., chloride, nitrate) vacuum deposited metal layer or a layer containing an ionic polymer described in U.S. Pat. Nos. 2,861,056 and 3,206,312 or an insoluble inorganic salt described in U.S. Pat. No. 3,428,451.

The method of obtaining a color image using the photothermographic material of the present invention includes the method described in JP-A-7-13295, from page 10, left column, line 43 to page 11, left column, line 40. Examples of the stabilizer for the color dye image are described in British Patent 1,326,889 and U.S. Pat. Nos. 3,432,300, 3,698,909, 3,574,627, 3,573,050, 3,764,337 and 4,042,394.

The heat-developable photographic (photothermographic) emulsion for use in the present invention can be coated by various coating operations including dip coating, air knife coating, flow coating and extrusion coating using a hopper described in U.S. Pat. No. 2,681,294. If desired, two or more layers may be simultaneously coated by the method described in U.S. Pat. Nos. 2,761,791 and British Patent 837,095.

The photothermographic material of the present invention may contain additional layers such as a dye-accepting layer for accepting a mobile dye image, an opacifying layer when a reflective printing is intended, a protective topcoat layer and a primer layer known in the light-heat photographic technology. It is preferred for the light-sensitive material of the present invention that an image can be formed only by one sheet of the light-sensitive material and functional layers necessary for forming the image, such as an image-receiving layer, do not constitute another light-sensitive material.

The light-sensitive material of the present invention may be developed by any method, however, the light-sensitive material after imagewise exposure is usually developed by raising the temperature thereof. The development temperature is preferably from 80 to 250° C., more preferably from 100 to 140° C. The development time is preferably from 1 to 180 seconds, more preferably from 10 to 90 seconds.

The light-sensitive material of the present invention may be exposed by any method, however, a laser light is preferably used as the light source for exposure. The laser light for use in the present invention is preferably gas laser, YAG laser, dye laser or semiconducting laser. Further, a semiconducting laser together with a second harmonic generation element may also be used.

The present invention will be described in greater detail below by referring to the Examples, however, the present invention should not be construed as being limited thereto.

EXAMPLE 1

Preparation of Silver Halide Grains:

Into 700 ml of water, 20 g of phthalated gelatin and 30 mg of potassium bromide were dissolved, and after adjusting the pH to 4.9 at a temperature of 35° C., 159 ml of an aqueous solution containing 18.6 g of silver nitrate and an aqueous solution containing potassium bromide and potassium iodide at a molar ratio of 92:8 were added by a control double jet method over 10 minutes while keeping the pAg at 7.7. Subsequently, 480 ml of an aqueous solution containing 55.4 g of silver nitrate and an aqueous solution containing 9 μmol/l of dipotassium hexachloroiridate and 1 mol/l of potassium bromide were added by a control double jet method over 30 minutes while keeping the pAg at 7.7. Thereafter, the pH was lowered to cause coagulation precipitation to thereby effect desalting, 0.1 g of phenoxy ethanol was added, and the pH and the pAg were adjusted to 5.9 and 8.2, respectively, thus completing the preparation of silver iodobromide grains (cubic grains; iodine content: core: 8 mol %, average: 2 mol %; average size: 0.05 μm; coefficient of variation of the projected area: 9%; (100) face ratio: 82%).

The temperature of the thus-obtained silver halide grains was raised to 60° C., and thereto 92 μmol/mol-Ag of sodium thiosulfate, 12 μmol/mol-Ag of 2,3,4,5,6-pentafluorophenyldiphenylphosphine selenide, 12 μmol/mol-Ag of Tellurium Compound 1, 2.5 μmol/mol-Ag of chloroauric acid and 180 μmol of thiocyanic acid were added. After ripening for 120 seconds, the emulsin was rapidly cooled to 30° C. to obtain a silver halide emulsion.

Preparation of Organic Acid Silver Emulsion 1.3 g of stearic acid, 0.5 g of arachidic acid, 8.5 g of behenic acid and 300 ml of distilled water were mixed at 90° C. for 15 minutes, 31.1 ml of a 1N-NaOH aqueous solution was added thereto over 15 minutes while vigorously stirring, and then the temperature of the mixture was lowered to 50° C. Thereafter, 7 ml of a 1N-phosphoric acid aqueous solution was added and after adding thereto 0.12 g of N-bromosuccinimide while stirring more vigorously, silver halide grains previously prepared were added in an amount of 2.5 mmol in terms of silver halide. Further, 25 ml of an 1N-silver nitrate aqueous solution was added over 3 minutes and stirring was continued as it is for 90 minutes. Thereafter, the solids content was separated by suction filtration and the solids content was washed with water until the conductivity of the filtered water became 30 μS/cm. To the thus-obtained solids content, 37 g of a 1.2 wt % butyl acetate solution of polyvinyl acetate was added, and the mixture was stirred. The stirring was stopped and the mixed solution was left standing to separate into an oil layer and an aqueous layer. The aqueous layer was removed together with the salt contained therein to obtain the oil layer. To this oil layer, 20 g of a 2.5 wt % 2-butanone solution of polyvinyl butyral (Denka-Butyral #3000-K, produced by Denki Kagaku Kogyo KK) was added, and the mixture was stirred. Further, 0.12 mmol of pyridinium bromide perbromide and 0.14 mmol of calcium bromide dihydrate were added together with 0.7 g of methanol. Then, 40 g of 2-butanone and 7.8 g of polyvinyl butyral (BUTVAR™B-76, produced by Monsant KK) were added thereto and the mixture was dispersed in a homogenizer to obtain an organic acid silver salt emulsion (acicular grains, average short axis length: 0.05 μm, average long axis length: 1.8 μm, coefficient of variation: 28%).

Preparation of Coating Solution for Emulsion Layer:

To the organic acid silver emulsion obtained above, chemicals were added each to-give the amount shown below per mol of silver. 9 mg of sodium phenylthiosulfonate, 0.18 mmol of Comparative Dye 1, 2.2 g of 2-mercapto-5-methylbenz-imidazole, 21.5 g of 4-chlorobenzophenone-2-carboxylic acid, 580 g of 2-butanone and 220 g of dimethylformamide were added at 25° C. while stirring and the mixture was left standing for 3 hours. Subsequently, 8 g of 5-tribromomethylsulfonyl-2-methylthiazole, 6.2 g of 2-tribromomethylsulfonylbenzothiazole, 4.8 g of 4,6-ditrichloromethyl-2-phenyltriazine, 2 g of Disulfide Compound 1, 152 g of 1,1-bis(2-hydroxy-3,5-dimethylphenyl)-3,5,5-trimethylhexane, 1.1 g of Megafacs F-176P (fluorine-base surface active agent, produced by Dai-Nippon Ink & Chemicals, Inc.), 590 g of 2-butanone and 10 g of methyl isobutyl ketone were added while stirring.

Coating Solution for Protective Layer of Emulsion Surface:

75 g of CAB171-15S (cellulose acetate butyrate, produced by Eastman Chemical KK), 5.7 g of 4-methylphthalic acid, 1.5 g of tetrachlorophthalic anhydride, 5.2 g of tetrachlorophthalic acid, 12.6 g of phthalazine, 0.3 g of Megafacs F-176P, 1.5 g of Sildex H31 (spherical silica, average size: 3 μm, produced by Dokai Kagaku KK) and 6 g of Sumidur N3500 (polyisocyanate, produced by Sumitomo Beyer Urethane KK) were dissolved in 3,070 g of 2-butanone and 30 g of ethyl acetate to prepare the coating solution.

Coating Solution for Back Surface:

Calcium Compound 1 was synthesized as follows. To 1 l of an ethanol solution containing 0.08 mol of 3,5-di-tertbutylcatechol, 167 ml of an aqueous solution containing 0.019 mol of calcium chloride and 125 ml of a 25% aqueous ammonia were added, and air was blown thereinto at room temperature for 3 hours to deposit crystals (Calcium Compound 1) of bis[2-(3,5-di-tert-butyl-o-benzoquinone monoimine)-4,6-di-tert-butyl phenolato]calcium(II).

12 g of polyvinyl butyral (Denka-Butyral #4000-2, produced by Denki Kagaku Kogyo KK), 12 g of CAB381-20 (cellulose acetate butyrate, produced by Eastman Chemical KK), 120 mg of Dye 1, 280 mg of Calcium Compound 1, 310 mg of Dye 2, 6 mg of Dye 3, 0.4 g of Sildex H121 (spherical silica, average size: 12 μm, produced by Dokai Kagaku KK), 0.4 g of Sildex H51 (spherical silica, average size: 5 μm, produced by Dokai Kagaku KK), 0.1 g of Megafacs F-176P and 2.2 g of Sumidur N3500 were added to 500 g of 2-butanone and 500 g of 2-propanol while stirring, and dissolved and mixed.

The coating solution for the emulsion layer prepared above was coated on a 175 μm-thick polyethylene terephthalate support tinted by a blue dye to have a silver coverage of 2.3 g/m$^2$. Thereafter, the coating solution for the back surface was coated on the surface opposite the emulsion layer to have an optical density at 810 nm of 0.7. Further, the coating solution for the protective layer of the emulsion surface was coated on the emulsion surface to have a dry thickness of 2 μm. Thus, Light-Sensitive Material 1–01 was obtained. Light-Sensitive Materials 1–02 to 1–10 were also prepared by adding an equimolar amount of Comparative Dye 2, 3 or 4 or Dye 29, 36, 37, 38, 39 or 40 in place of Comparative Dye 1. The thus-obtained light-sensitive materials each had a smoothness (Beck smoothness determined according to the Ohken's Smoothness Measurement described in J. TAPPI, Kami Pulp Shiken-ho (Paper Pulp Testing Method), No. 5) of 800 seconds on the emulsion surface and 75 seconds on the back surface.

Comparative Dye 1

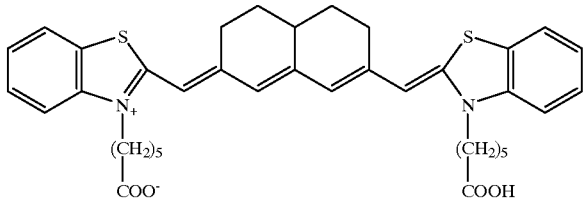

Comparative Dye 2

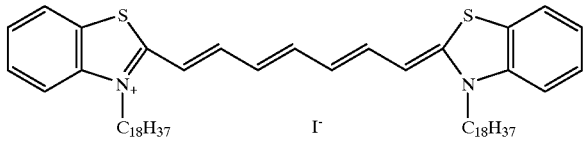

Comparative Dye 3

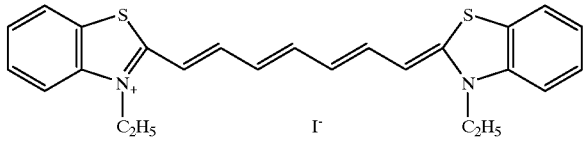

Comparative Dye 4

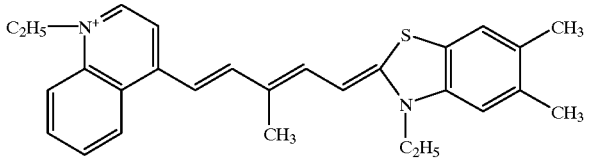

Tellurium Compound 1

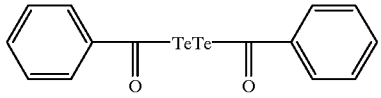

Disulfide Compound 1

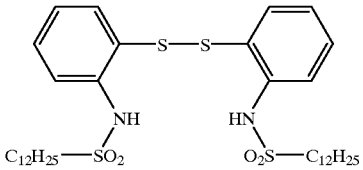

Dye 1

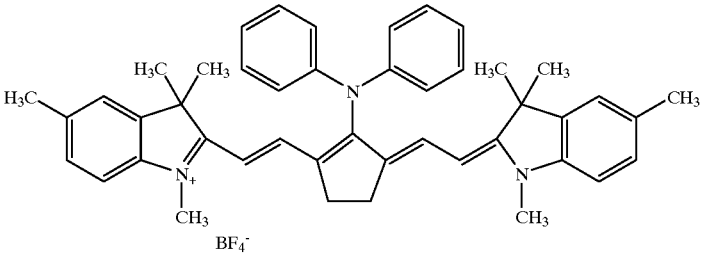

-continued

Blue Dye

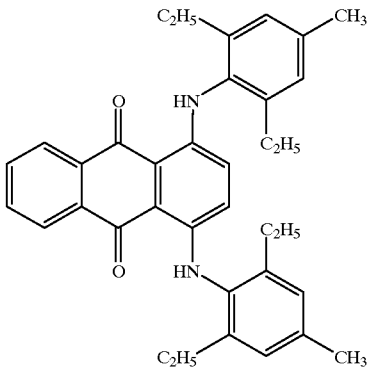

Dye 2

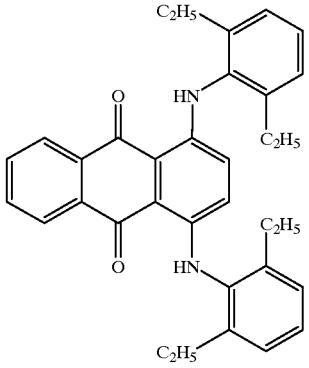

Dye 3

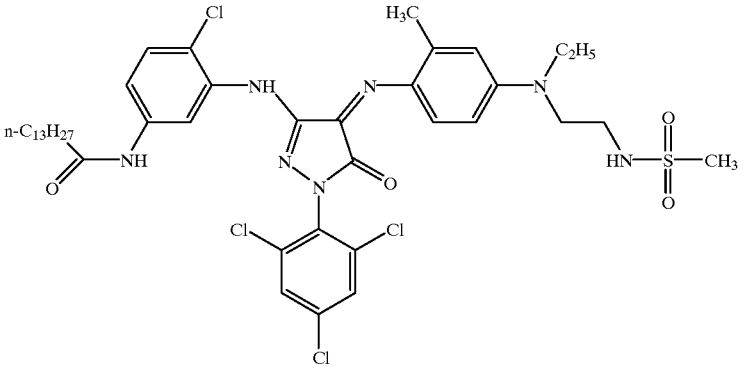

Evaluation of Photographic Capability:

Each photographic light-sensitive material was exposed in a laser sensitometer equipped with a diode of 820 nm and then processed (developed) at 120° C. for 15 seconds. The images obtained were evaluated by a densitometer. The results of measurement were evaluated by Dmin and sensitivity (a reciprocal of the ratio of the exposure amount necessary for giving a density 1.0 higher than Dmin). The sensitivity was shown by a relative value to the Light-Sensitive Material 1–01 taken as 100.

Evaluation of Aging Storability:

Samples each was left standing one day under conditions of 25° C. and 65% RH. 10 sheets of each photographic light-sensitive material were sealed in a bag made of a moisture proofing material, the bag was further placed in a decorative bag in a size of 35.1 cm×26.9 cm×3.0 cm, and after aging at 50° C. for 7 days, Dmin and sensitivity (shown by a relative value to Light-Sensitive Material 1–01 which was not aged, taken as 100) were measured. The sign "-" indicates that density 1.0 higher than Dmin could not be obtained.

The results obtained are shown in Table 1 below. It is seen that the sensitivity is high and the aging storability is excellent within the scope of the present invention.

TABLE 1

| | Dye | Sensitivity | Dmin | Sensitivity after Aging | Dmin after Aging | |
|---|---|---|---|---|---|---|
| 1-01 | Comparative Dye 1 | 100 | 0.22 | 3 | 0.50 | Comparison |
| 1-02 | Comparative Dye 2 | 40 | 0.17 | 3 | 0.44 | Comparison |
| 1-03 | Comparative Dye 3 | 50 | 0.17 | — | 0.32 | Comparison |
| 1-04 | Comparative | 30 | 0.18 | — | 0.35 | Comparison |

TABLE 1-continued

| | Dye | Sensitivity | Dmin | Sensitivity after Aging | Dmin after Aging | |
|---|---|---|---|---|---|---|
| | Dye 4 | | | | | |
| 1-05 | Compound 29 | 100 | 0.17 | 105 | 0.19 | Invention |
| 1-06 | Compound 36 | 200 | 0.17 | 190 | 0.18 | Invention |
| 1-07 | Compound 37 | 120 | 0.17 | 120 | 0.19 | Invention |
| 1-08 | Compound 38 | 97 | 0.18 | 90 | 0.18 | Invention |
| 1-09 | Compound 39 | 90 | 0.17 | 65 | 0.18 | Invention |
| 1-10 | Compound 40 | 100 | 0.17 | 80 | 0.19 | Invention |

EXAMPLE 2

Preparation of Organic Acid Silver Emulsion 840 g of behenic acid and 95 g of stearic acid were added to 10 l of water and while keeping the temperature at 90° C., 48 g of sodium hydroxide and 63 g of sodium carbonate dissolved in 1.5 l of water were added. After stirring for 30 minutes, the temperature was lowered to 50° C., 1.1 l of an N-bromosuccinimide 1% aqueous solution was added, and subsequently, 2.3 l of a silver nitrate 17% aqueous solution was gradually added while stirring. Further, after lowering the liquid temperature to 35° C., 1.5 l of a potassium bromide 2% aqueous solution was added over 2 minutes, the mixed solution was stirred for 30 minutes, and 2.5 l of an N-bromosuccinimide 1% aqueous solution was added. While stirring this aqueous mixture, 3,300 g of a butyl acetate solution containing 1.2 wt % of polyvinyl acetate was added, the solution was left standing still for 10 minutes to separate into two layers, the aqueous layer was removed, and the remaining gel was washed with water twice. The thus-obtained gelled mixture of silver behenate/stearate and silver bromide was dispersed with 1,800 g of a 2.6% isopropyl alcohol solution of polyvinyl butyral (Denka-Butyral #3000-K, produced by Denki Kagaku Kogyo KK) and further dispersed together with 600 g of polyvinyl butyral (Denka-Butyral #4000-2, produced by Denki Kagaku Kogyo KK) and 300 g of isopropyl alcohol to obtain an organic acid silver salt emulsion (acicular grains, average short axis length: 0.04 μm, average long axis length: 1.5 μm, coefficient of variation: 30%).

Preparation of Coating Solution for Emulsion Layer:

To the organic acid silver emulsion obtained above, chemicals were added each to give the amount shown below per mol of silver. 10 mg of sodium phenylthiosulfonate, 0.1 mmol of Comparative Dye 1, 2.1 g of 2-mercapto-5-methylbenzimidazole, 22 g of 4-chlorobenzophenone-2-carboxylic acid, 580 g of 2-butanone and 220 g of dimethylformamide were added at 25° C. while stirring, and the mixture was left standing for 3 hours. Subsequently, 8 g of 5-tribromomethylsulfonyl-2-methylthiazole, 6 g of 2-tribromomethylsulfonylbenzothiazole, 5 g of 4,6-ditrichloromethyl-2-phenyltriazine, 2 g of Disulfide Compound 1, 180 g of 1,1-bis(2-hydroxy-3,5-dimethylphenyl)-3,5,5-trimethylhexane, 5.5 g of tetrachlorophthalic acid, 13.3 g of phthalazine, 3 g of Hydrazine Compound a, 1 g of Megafacs F-176P (fluorine-base surface active agent, produced by Dai-Nippon Ink & Chemicals, Inc.), 590 g of 2-butanone and 10 g of methyl isobutyl ketone were added while stirring.

Coating Solution for Protective Layer of Emulsion Surface:

75 g of CAB171-15S (cellulose acetate butyrate, produced by Eastman Chemical KK), 5.7 g of 4-methylphthalic acid, 1.5 g of tetrachlorophthalic anhydride, 0.3 g of Megafacs F-176P, 2 g of Sildex H31 (spherical silica, average size: 3 μm, produced by Dokai Kagaku KK) and 7.2 g of Sumidur N3500 (polyisocyanate, produced by Sumitomo Beyer Urethane KK) were dissolved in 3,070 g of 2-butanone and 30 g of ethyl acetate to prepare the coating solution.

Preparation of Support having Back Surface:

12 g of CAB381-20 (cellulose acetate butyrate, produced by Eastman Chemical KK), 120 mg of Dye 1, 0.4 g of Sildex H121 (spherical silica, average size: 12 μm, produced by Dokai Kagaku KK), 0.4 g of Sildex H51 (spherical silica, average size: 5 μm, produced by Dokai Kagaku KK), 0.1 g of Megafacs F-176P and 2.2 g of Sumidur N3500 were added to 500 g of 2-butanone and 500 g of 2-propanol while stirring, and dissolved and mixed. The thus-prepared coating solution for the back surface was coated on non-colored polyethylene terephthalate film having on both surfaces thereof a moisture proofing undercoat containing vinylidene chloride to have an optical density at 810 nm of 0.7.

The coating solution for emulsion layer was coated on the support prepared above to have a silver coverage of 2 g/m$^2$, and the coating solution for the protective layer of the emulsion surface was coated on the emulsion surface to have a dry thickness of 2 μm to obtain Light-Sensitive Material 2-01. Light-Sensitive Materials 2-02 to 2-04 were prepared using Dye 36, 37 or 40 in place of Comparative Dye 1.

Hydrazine Compound a

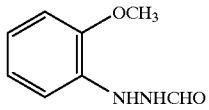

Evaluation of Photographic Capability of Light-Sensitive Material:

Each photographic light-sensitive material was exposed in a He-Ne laser sensitometer of 633 nm and then processed (developed) at 115° C. for 25 seconds. After the development, each light-sensitive material was exposed to a halogen lamp for 15 seconds to decolorize the dye of the back layer. The images obtained were evaluated by a densitometer. The results of measurement were evaluated by Dmin and sensitivity (a reciprocal of the exposure amount necessary for giving a density 3.0 higher than Dmin). Further, points of densities 0.3 and 3.0 on the characteristic curve were connected by a straight line and the gradient was shown as the gradation γ. The sensitivity was shown by a relative value to Light-Sensitive Material 2–01 taken as 100.

Evaluation of Aging Storability:

Samples each was left standing one day under conditions of 25° C. and 60% RH. 10 sheets of each photographic light-sensitive material were sealed in a bag made of a moisture proofing material, the bag was further placed in a decorative bag in a size of 35.1 cm×26.9 cm×3.0 cm, and after aging at 50° C. for 7 days, sensitivity (shown by a relative value to Light-Sensitive Material 2-01 which was not aged, taken as 100) was measured. The sign "-" indicates that density 3.0 higher than Dmin could not be obtained.

The results obtained are shown in Table 2 below. It is seen that light-sensitive materials having high sensitivity, low fogging and good storability could be obtained within the scope of the present invention.

TABLE 2

| | Dye | Sensitivity | Dmin | γ | Sensitivity after Aging | |
|---|---|---|---|---|---|---|
| 2-01 | Comparative Dye 1 | 100 | 0.18 | 10 | — | Comparison |
| 2-02 | Compound 36 | 100 | 0.15 | 12 | 100 | Invention |
| 2-03 | Compound 37 | 120 | 0.15 | 14 | 110 | Invention |
| 2-04 | Compound 40 | 100 | 0.16 | 12 | 90 | Invention |

According to the present invention, a light-sensitive material having high sensitivity, low fogging, high contrast, good storability and excellent face properties can be obtained.

What is claimed is:

1. A photothermographic material comprising a support having on at least one surface thereof a light-sensitive silver halide grain, an organic silver salt, a reducing agent for silver ion and a binder, wherein said photothermographic material contains a methine dye represented by the following formula (I):

$$(MET)_{k1}-[(Q)_{k2}-Ar]_{k3} \quad (I)$$

wherein MET represents an atomic group having a methine dye structure; Q represents a divalent linking group comprising an atom or atomic group including at least one of a carbon atom, a nitrogen atom, a sulfur atom and an oxygen atom; Ar represents a group having a polycyclic aromatic ring system compound comprising 8 or more atoms exclusive of nitrogen; k1 represents 1 or 2; k2 represents 0 or 1; and k3 represents 1, 2, 3 or 4.

2. A photothermographic material as claimed in claim 1, wherein said light-sensitive silver halide grain is spectrally sensitized in the range of from 600 to 1,400 nm.

3. A photothermographic material as claimed in claim 1, wherein the polycyclic aromatic ring represented by Ar is the following (a) to (t):

(a)

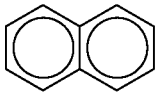

(b)

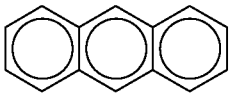

(c)

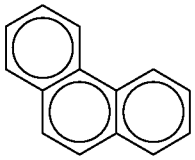

-continued (d)

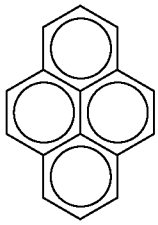

(e)

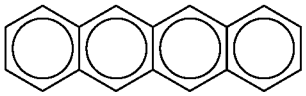

(f)

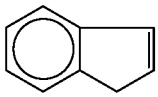

(g)

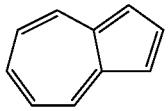

(h)

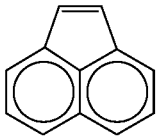

(i)

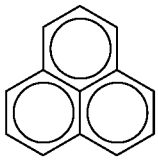

(j)

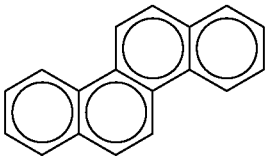

(k)

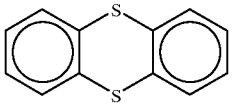

(l)

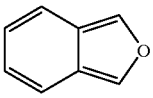

(m)

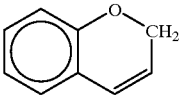

-continued (n)

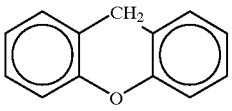

(o)

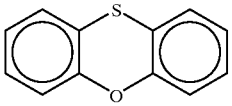

(p)

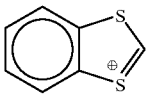

(q)

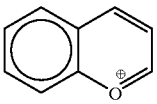

(r)

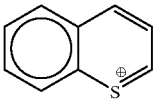

(s)

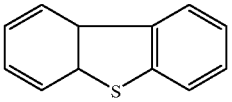

(t)

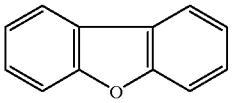

4. A photothermographic material as claimed in claim 1, wherein MET is represented by formula (II) or (III):

(II)

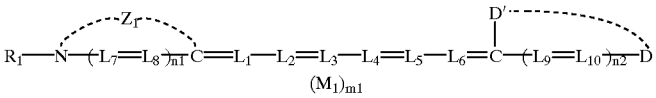

(III)

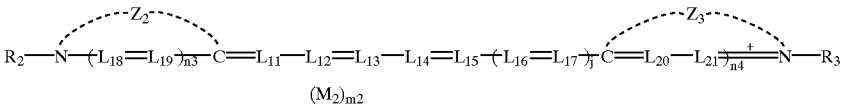

wherein $Z_1$, $Z_2$ and $Z_3$ each represents an atomic group necessary for forming a 5- or 6-membered nitrogen-containing heterocyclic ring, D and D' each represents an atomic group necessary for forming a non-cyclic or cyclic acidic nucleus, $R_1$, $R_2$ and $R_3$ each represents an alkyl group, $L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$ and $L_{21}$ each represents a methine group or a substituted methine group, which may form a ring with other methine group or with an auxochrome, n1, n2, n3 and n4 each represents 0 or 1, j represents 0 or 1, $M_1$ and $M_2$ each represents a charge neutralizing counter ion, and m1 and m2 each represents a number of 0 or greater necessary for naturalizing the charge within the molecule.

5. A photothermographic material as claimed in claim 4, wherein the nucleus formed by $Z_1$, $Z_2$ or $Z_3$ is a benzothiazole nucleus a naphthothiazole nucleus, a benzoxazole nucleus, a naphthoxazole nucleus, a benzimidazole nucleus, a 2-quinoline nucleus or a 4-quinoline nucleus.

6. A photothermographic material as claimed in claim 4, wherein the nucleus formed by formed by D or D' is 3-alkylrhodanine, 3-alkyl-2-thioxazolidin-2,4-dione or 3-alkyl-2-thiohydantoin.

7. A photothermographic material as claimed in claim 4, wherein $L_4$ and $L_{14}$ each is an unsubstituted methine group; a methine group substituted by an unsubstituted alkyl group, an alkoxy group, an amino group or a halogen atom; or a methine group substituted by the acidic nucleus represented by D or D', and the other L groups each is an unsubstituted methine group.

8. A photothermographic material as claimed in claim 4, wherein the methine dye represented by formula (I) is represented by formula (I-a):

(I-a)

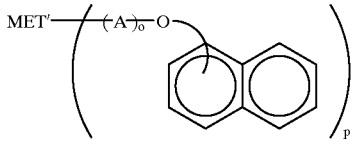

wherein A represents a methylene group, o represents 1, 2, 3, 4 or 5, p represents 1 or 2, and MET' represents pentamethine cyanine or heptamethine cyanine represented by formula (III).

9. A photothermographic material as claimed in claim 8, wherein the heterocyclic nucleus completed by $Z_2$ or $Z_3$ is a benzothiazole nucleus, a naphthothiazole nucleus, a 4-quinoline nucleus or a nucleus where a benzene ring is further condensed to the benzothiazole, naphthothiazole or 4-quinoline nucleus, and where the heterocyclic nucleus may have a substituent.

10. A photothermographic material as claimed in claim 8, wherein when MET' is the pentamethine cyanine dye, $Z_2$ and $Z_3$ are a combination of a naphthothiazole nucleus or a benzothiazole nucleus and a 4-quinoline nucleus.

11. A photothermographic material as claimed in claim 8, wherein when MET' is the heptamethine cyanine dye, $Z_2$ and $Z_3$ are selected from a benzothiazole nucleus and a naphthothiazole nucleus.

12. A photothermographic material as claimed in claim 1, wherein the cyanine dye represented by formula (I) is used in an amount of from $10^{-6}$ to 1 mol per mole of silver halide.

13. A photothermographic material as claimed in claim 1, wherein the light-sensitive silver halide is used in an amount of from 0.01 to 0.5 mol per mol of the organic silver salt.

14. A photothermographic material as claimed in claim 1, wherein the organic silver salt is used in an amount of from 0.1 to 5 $g/m^2$.

15. A photothermographic material as claimed in claim 1, wherein k1 represents 1 and k3 represents 1 or 2.

16. A photothermographic material as claimed in claim 8, wherein p is 2.

17. A photothermographic material as claimed in claim 2, wherein said light-sensitive silver halide grain is spectrally sensitized in the range of from 750 to 1,400 nm.

18. A photothermographic material as claimed in claim 13, wherein the light-sensitive silver halide is used in an amount of from 0.02 to 0.3 mol per mol of the organic silver salt.

19. A photothermographic material as claimed in claim 18, wherein the light-sensitive silver halide is used in an amount of from 0.03 to 0.25 mol per mol of the organic silver salt.

20. A photothermographic material as claimed in 14, wherein the organic silver salt is used in an amount of from 1 to 3 g/m2.

* * * * *